US005863036A

United States Patent [19]

Tanaka et al.

[11] Patent Number: 5,863,036

[45] Date of Patent: Jan. 26, 1999

[54] SHEET FEEDING DEVICE AND IMAGE FORMING APPARATUS HAVING THE SAME

[75] Inventors: Yoshiaki Tanaka, Kawasaki; Eiji Takenaka, Atsugi; Iwao Matsumae, Tokyo, all of Japan

[73] Assignee: Ricoh Company, Ltd., Tokyo, Japan

[21] Appl. No.: 732,690

[22] Filed: Oct. 18, 1996

[30] Foreign Application Priority Data

| | | | |
|---|---|---|---|
| Oct. 20, 1995 | [JP] | Japan | 7-272329 |
| Nov. 8, 1995 | [JP] | Japan | 7-289633 |
| Feb. 26, 1996 | [JP] | Japan | 8-038498 |

[51] Int. Cl.[6] ..... B65H 3/52

[52] U.S. Cl. ..... 271/10.11; 271/10.13; 271/121; 271/126; 271/127

[58] Field of Search ..... 271/10.11, 10.13, 271/121, 124, 126, 127

[56] References Cited

U.S. PATENT DOCUMENTS

| | | | |
|---|---|---|---|
| 4,535,981 | 8/1985 | Watanabe et al. | 271/121 |
| 5,244,191 | 9/1993 | Kanekura | 271/10.11 |
| 5,253,854 | 10/1993 | Tanoue et al. | 271/124 |
| 5,255,903 | 10/1993 | Parsons et al. | 271/124 |
| 5,358,230 | 10/1994 | Ikemori et al. | 271/121 |
| 5,372,359 | 12/1994 | Miura et al. | 271/121 |
| 5,374,047 | 12/1994 | Tsukamoto et al. | 271/121 |
| 5,386,983 | 2/1995 | Ando | 271/124 |

*Primary Examiner*—William E. Terrell
*Assistant Examiner*—Patrick Mackey
*Attorney, Agent, or Firm*—Oblon, Spivak, McClelland, Maier & Neustadt, P.C.

[57] ABSTRACT

A sheet feeding device for feeding sheets from a tray one by one and an image forming apparatus having the same are disclosed. A tray loaded with a stack of sheets, a separating member for separating a sheet paid out from the tray from the other sheets, and a driven conveyor roller are sequentially arranged around a single pick-up roller. With this arrangement, it is possible to reduce to a load to act on the sheet being conveyed by the pick-up roller and conveyor roller, and to prevent accidental continuous feed or simultaneous feed of a plurality of sheets.

15 Claims, 28 Drawing Sheets

SHEET FEEDING DEVICE AND IMAGE FORMING APPARATUS HAVING THE SAME

BACKGROUND OF THE INVENTION

The present invention relates to a sheet feeding device for feeding sheets from a tray one by one, and an image forming apparatus including the same.

A printer, facsimile apparatus, copier or similar electrophotographic image forming apparatus has a photoconductive drum or similar image carrier for forming a toner image thereon. A sheet feeding device built in the apparatus feeds sheets one by one to the image carrier, so that toner images are transferred from the image carrier to the sheets. Generally, the sheet feeding device is made up of a sheet feeding and separating section and a sheet conveying section. The feeding and separating section feeds the top sheet from a stack loaded on a tray while separating it from the underlying sheets. The conveying section conveys the separated sheet to an image transfer station adjoining the image carrier. The problem with the conventional sheet feeding device is that the feeding and separating section and the conveying section are each implemented as an independent unit. As a result, the entire device needs a great number of parts and obstructs the compact design of an image forming apparatus. Moreover, an exclusive drive transmission mechanism must be assigned to each of the two sections, increasing the cost of the apparatus. In addition, it is difficult with the conventional device to reduce a load to act on a sheet being conveyed. Therefore, sure sheet separation and smooth sheet pay-out and conveyance are difficult to achieve.

SUMMARY OF THE INVENTION

It is therefore an object of the present invention to provide a sheet feeding device free from the problems discussed above, and an image forming apparatus having the same.

In accordance with the present invention, a sheet feeding device for an image forming apparatus includes a pick-up roller operatively connected to and driven in synchronism with an image forming section included in the image forming apparatus. A tray is loaded with a stack of sheets. A first biasing member constantly biases the tray such that the top of the stack of sheets is pressed against the periphery of the pick-up roller. A separating member is located downstream of the tray in the intended direction of sheet feed and movable into and out of contact with the periphery of the pick-up roller. A second biasing member constantly biases the separating member such that the separating member is pressed against the periphery of the pick-up roller. A driven conveyor roller is located downstream of the separating member in the intended direction of sheet feed, and rotatably contacts the periphery of the pick-up roller. A third biasing member constantly biases the driven conveyor roller against the periphery of the pick-up roller. A cam is controllably driven by a drive system different from a drive system assigned to the pick-up roller to rotate in the same direction as the pick-up roller. The cam has a first cam portion for causing the tray to move toward the pick-up roller due to the force of the first biasing member, and a second cam portion for causing the separating member to move toward the pick-up roller due to the force of the second biasing member. A bias cancelling device cancels, after the cam has rotated a predetermined angle, the pressing contact of the tray and separating member with the periphery of the pick-up roller. A regulating member is provided which does not interfere with a conveyance path when the separating member is pressed against the pick-up roller, but exists in the transport path open when the separating member is released from the pick-up roller, so as to interfere with the following sheet.

Also, in accordance with the present invention, a sheet feeding device includes a pick-up roller driven to rotate. A tray is loaded with a stack of sheets and constantly biased by a first biasing member such that the top of the stack abuts against the pick-up roller. A separating member is located downstream of the tray in the intended direction of sheet feed and contacts, under the action of a second biasing member, the pick-up roller to thereby retain a sheet paid out together with a top sheet with a frictional force. A driven conveyor roller is located downstream of the separating member in the intended direction of sheet feed and contacts, under the action of a third biasing member, the pick-up roller and is rotated by the pick-up roller to thereby convey the top sheet in cooperation with the pick-up roller.

Further, in accordance with the present invention, an image forming apparatus includes an image forming section for forming an image on a sheet. A pick-up roller is located upstream of the image forming section in the intended direction of sheet feed, and is rotated by and in synchronism with a drive section assigned to the image forming section. A tray is loaded with a stack of sheets and constantly biased by a first biasing member such that the top of the stack abuts against the pick-up roller. A separating member is located downstream of the tray in the intended direction of sheet feed and contacts, under the action of a second biasing member, the pick-up roller to thereby retain a sheet paid out together with a top sheet with a frictional force. A driven conveyor roller is located downstream of the separating member in the intended direction of sheet feed and contacts, under the action of a third biasing member, the pick-up roller and is rotated by the pick-up roller to thereby convey the top sheet in cooperation with the pick-up roller. A cam includes a larger diameter portion facing a part of the tray and separating member. A cam drive control section causes the cam to be rotated intermittently by and in synchronism with the drive section such that the cam releases the tray and separating member at the beginning of sheet feed or forces them away from the pick-up roller with the larger diameter portion just after the top sheet has moved away from a nip between the pick-up roller and driven conveyor roller.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
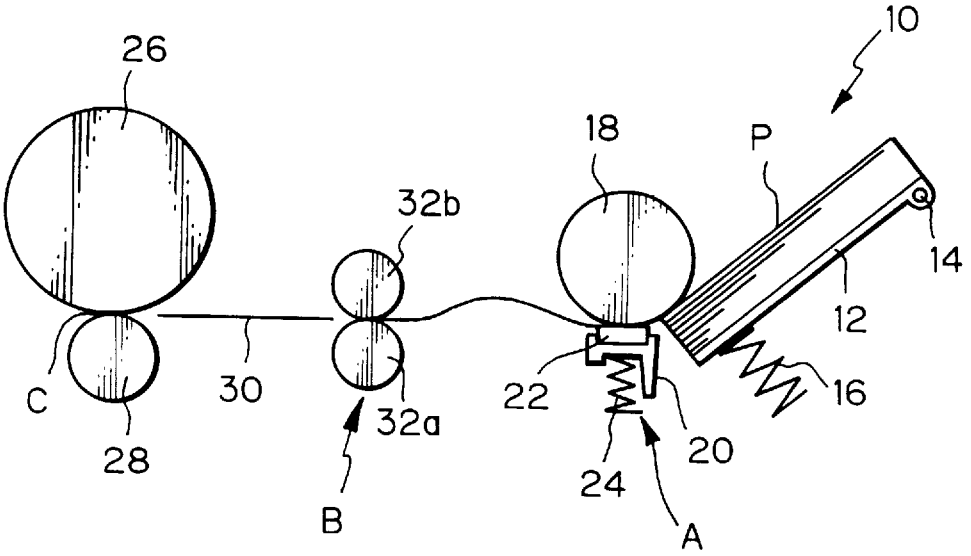
Fig. 1 PRIOR ART
FIG. 1 is a view showing an image forming apparatus with a conventional sheet feeding device.

To better understand the present invention, a brief reference will be made to a conventional sheet feeding device, shown in FIG. 1. As shown, the device, generally 10, includes a tray 12 rotatable about a fulcrum 14. A stack of papers or similar sheets P are loaded on the tray 12. The tray 12 is constantly biased by biasing means 16 such that the leading edge of the top sheet is pressed against a pick-up roller 18. A separating member or separator 20 is located downstream of the tray 12 in an intended direction of paper feed and has, e.g., a pad 22 having a high coefficient of friction. Biasing means 24 constantly biases the separator 20 such that the pad 22 remains in pressing contact with the pick-up roller 18. The tray 12, biasing means 16 and 24, pick-up roller 18 and separator 20 constitute a sheet separating and feeding section A. A photoconductive element in the form of a drum 26 and an image transfer roller 28 constitute an image transfer section C. A sheet transport path 30 extends from the sheet separating and feeding section A to the image transfer section C. A drive roller 32*a* and a driven roller 32*b* are provided in a pair on the sheet transport path 30 and constitute a sheet conveying section B.

In the sheet separating and feeding section A, the pick-up roller 18 pays out the top sheet from the stack P toward the separator 20 on the basis of friction acting therebetween. The separator 20 separates the top sheet P from the underlying sheets due to friction between the separator 20 and the sheet P and greater than the friction between the sheets P. The conveying section, or registering section as sometimes referred to, B conveys the sheet P toward the image transfer section C at a speed equal to or slightly higher than the moving speed of the drum 26. If the conveyance of the sheet P from the conveying section B to the image transfer section C is unstable, there occurs, e.g., the dislocation of an image transferred from the drum 26 to the sheet P.

In order to implement the above functions, the two sections A and B are each constructed into an independent unit and driven by an independent drive transmission mechanism including, e.g., an electromagnetic clutch. The drive transmission mechanism assigned to the section A is deactivated after the top sheet has been fed out to the section B. In addition, to free the section B from loads, the pick-up roller 18 is provided with a crescent cross-section, or a one-way clutch is mounted on the shaft of the roller 18.

A problem with the above sheet feeding device is that the sections A and B implemented as independent units include a great number of parts, and moreover obstruct the compact design of an image forming apparatus. Another problem is that the drive transmission mechanisms respectively assigned to the sections A and B must have their amounts and speeds of drive controlled independently of each other, resulting in the need for independent control mechanisms including clutches and actuators.

To promote the compact design of an image forming apparatus, Japanese Patent Laid-Open Publication No. 6-39841, for example, proposes a sheet feeding device having both a sheet separating function and a conveying function arranged around a pick-up roller. Specifically, the proposed device includes a pick-up roller having a crescent cross-section and rotatable to feed only the top sheet from a sheet stack. A conveyor roller is freely rotatable on the shaft of the pick-up roller. This conveyor roller cooperates with a conveyor roller, which is a drive roller, to feed a sheet paid out from the stack by nipping it therebetween. A separating member is selectively pressed against the pick-up roller. While the pick-up roller and separating member pay out the top sheet while separating it from the underlying sheets, the cooperative rollers drive it to the next station. Although this kind of configuration renders the entire apparatus compact, it is not practicable without resorting to the conveyor roller driven independently of the pick-up roller. Therefore, as to the number of parts, the proposed scheme does not constitute a noticeable improvement over the arrangement shown in FIG. 1. That is, because the pick-up roller has a crescent cross-section in order to reduce the load, there is needed the conveyor roller which is driven by an exclusive drive mechanism.

Figure 2:
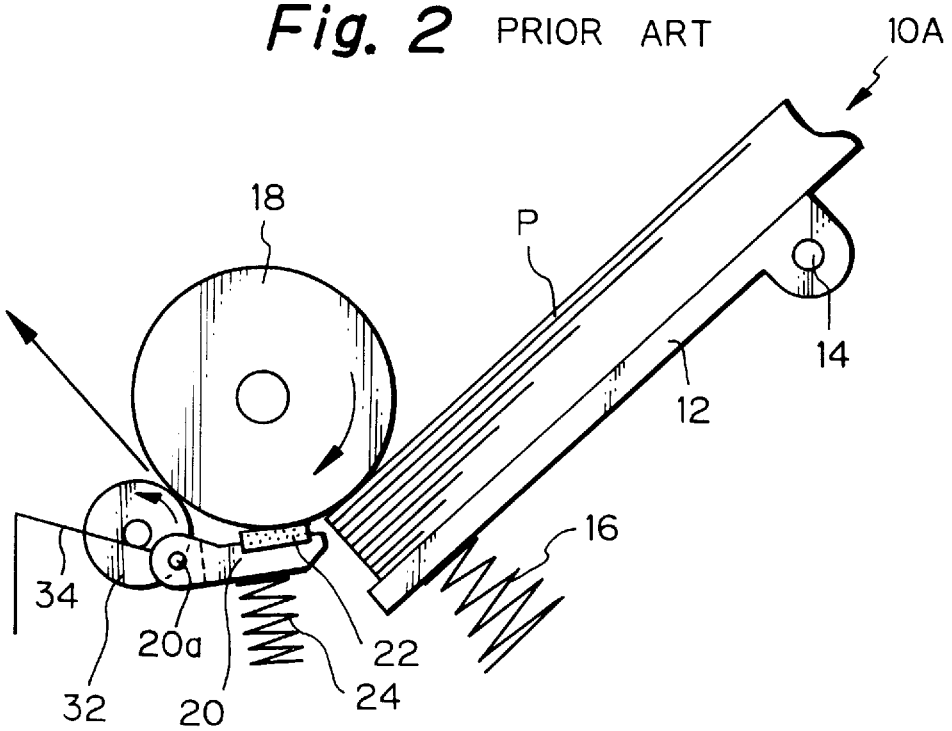
Fig. 2 PRIOR ART
FIG. 2 is a view showing another conventional sheet feeding device.

FIG. 2 shows another conventional sheet feeding device achieving both the sheet separating function and the sheet conveying function with a single roller to be driven, i.e., both the compact arrangement and the decrease in the number of parts. In FIG. 2, the same or similar structural elements as the elements shown in FIG. 1 are designated by the same reference numerals. As shown, the device, generally 10A, has a pick-up roller 18 rotated in synchronism with an image forming section, not shown, a tray 12 adjoining the roller 18, a separator 20, and a driven conveyor roller 32. The tray 12, separator 20 and conveyor roller 32 are biased against the pick-up roller 18 by biasing means 16, 24 and 34, respectively. The tray 12 loaded with a sheet stack P is rotatable about a fulcrum 14. Again, the separator 20 has a pad 22 and rotatable about a fulcrum 20*a* into and out of contact with the pick-up roller 18. The top sheet of the sheet stack P is constantly pressed against the pick-up roller 18. Only the top sheet P is paid out by the pick-up roller 18 while being separated from the others by the separator 20, i.e., pad 22. Then, the sheet P is conveyed to the image transfer station by the pick-up roller 18 and driven roller 32

In the above device 10A, the pick-up roller 18 and driven roller 32 have the function of conveying the sheet P to the next station This eliminates the need for the rollers or registration roller pair 32*a* and 32*b*, FIG. 1, and thereby contributes a great deal to the compact design of an image forming apparatus.

Now, in the device 10A, the pick-up roller 18 functions to separate and feed the sheet and to convey it to the next station at the same time. This requires the pick-up roller 18 to have a circular cross-section, considering the compact design, i.e., the decrease in the diameter of the roller 18. If the tray 12 and separator 20 remain in contact with the pick-up roller 18 when the roller 18 and driven roller 32 convey the sheet P, they constitute loads on the conveyance. Particularly, the load ascribable to the separator 20 is heavy because the separator 20 relies on friction. Such loads obstruct the smooth conveyance of the sheet to the next station. It is therefore necessary to release the tray 12 and separator 20 from the pick-up roller 18 as soon as the sheet reaches the driven roller 32. This can be done if use is made of, e.g., a cam rotatably mounted on the shaft of the pick-up roller 18.

Figure 3A:
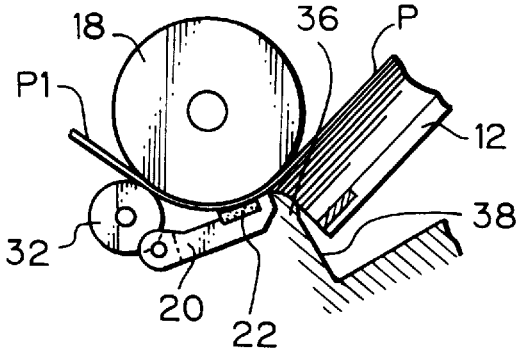
Fig. 3A PRIOR ART
FIGS. 3A–3D are views demonstrating how accidental continuous feed of sheets occurs in the device shown in FIG. 2.
Figure 3B:
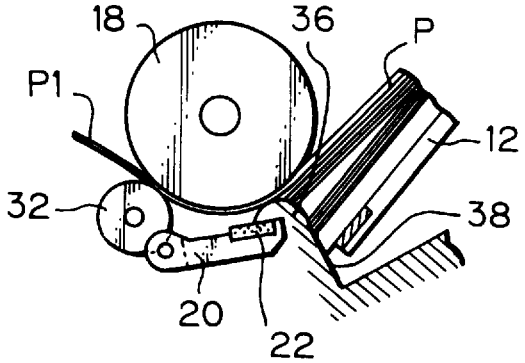
Fig. 3B PRIOR ART
Figure 3C:
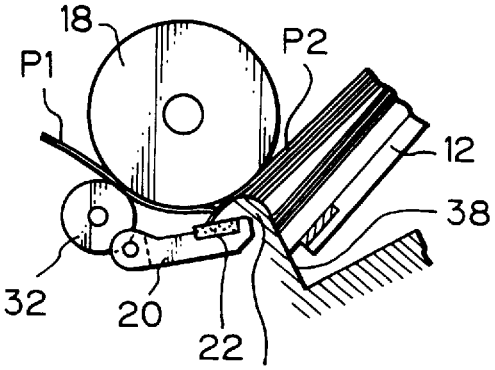
Fig. 3C PRIOR ART
Figure 3D:
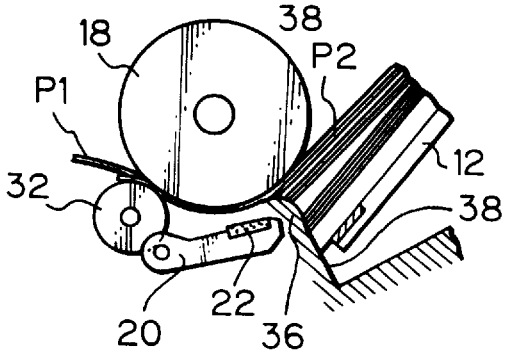
Fig. 3D PRIOR ART

However, releasing the tray 12 and separator 20 from the pick-up roller 18, as stated above, brings about a problem to be described with reference to FIGS. 3A–3D. The top sheet P1 is separated by the separator 20 (FIG. 3A), and then the cam is rotated to release the tray 12 and separator 20 from the pick-up roller 18 (FIG. 3B). As a result, several sheets P paid out from the tray 12 together with the top sheet P1, but left on the separator 20, are released from the separator 20 and apt to behave unstably. More specifically, several upper sheets P are left at an inlet 36 while the other sheets P are lowered together with the tray 12 along the wall of the inlet 36. After the top sheet P1 has moved away from the inlet 36, the sheet P2 now positioned on the top of the stack slips down through the open path between the pick-up roller 18 and the separator 20 due to its own weight (FIG. 3C). Consequently, the sheet P2 is partly brought into contact with the pick-up roller 18 constantly rotating in synchronism with the image forming section. The roller 18 drives the sheet P2 toward the driven roller 32 (FIG. 3D). The sheet P2 is apt to jam the transport path because it is conveyed at a timing different from a timing particular to a usual continuous printing process. Let this kind of sheet feed be referred to as accidental continuous feed.

The present invention obviates the above accidental continuous feed while using the arrangement in which a tray, separating member and driven conveyor roller are arranged around a single pick-up roller in order to implement a compact image forming apparatus including a minimum number of parts.

Preferred embodiments of the sheet feeding device in accordance with the present invention will be described hereinafter.

Figure 4:
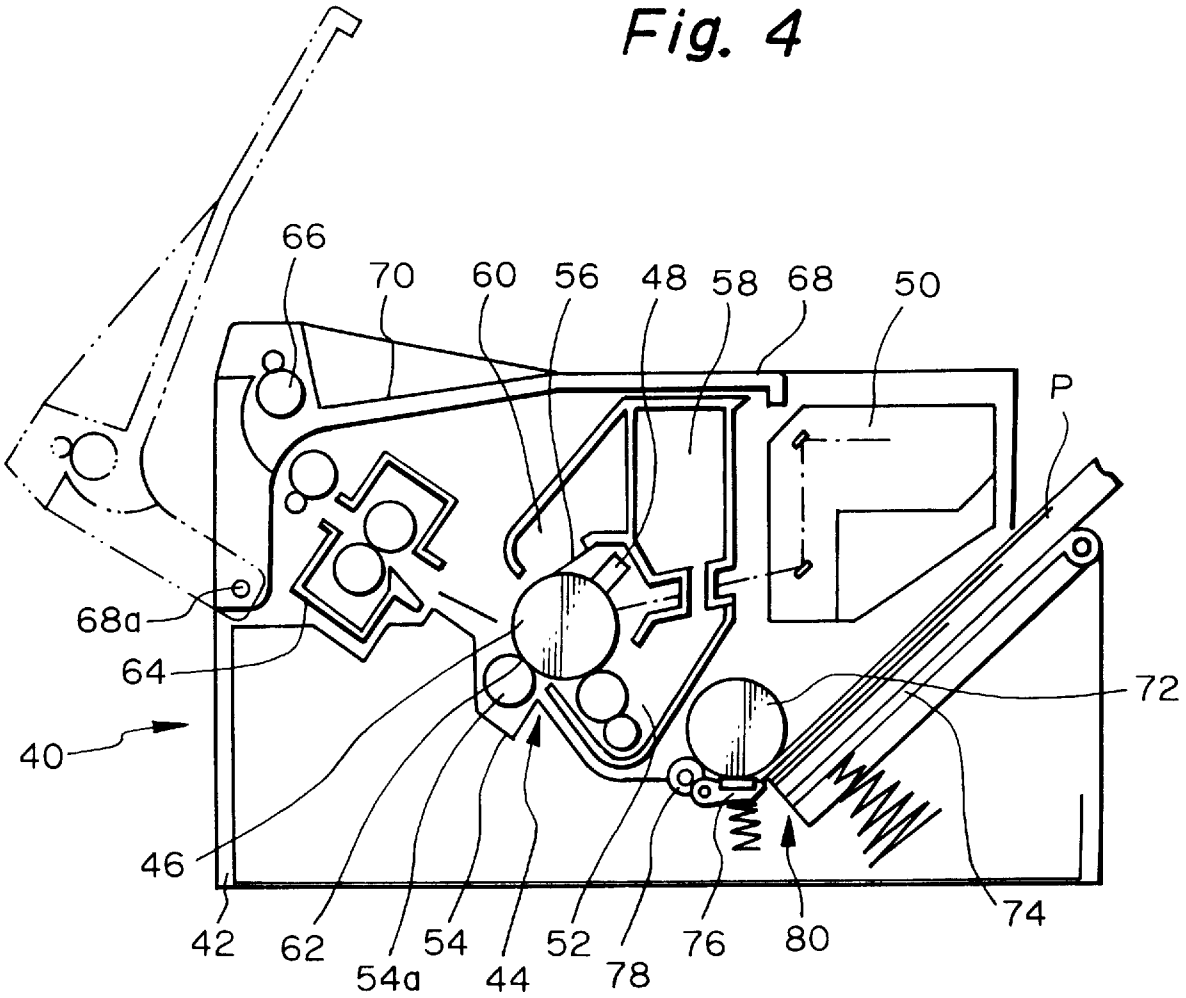
FIG. 4 is a section showing a printer to which a first to a fifth embodiment of the present invention are applicable.

FIG. 4 shows a compact electrophotographic printer which is a specific form of an image forming apparatus to which the embodiments are applicable. As shown, the printer, generally 40, has a body 42 including an image forming section 44. A photoconductive drum 46 is located at the center of the image forming section 44. Sequentially arranged around the drum 46 are a main charger 48, optics 50 for optically writing an image on the drum 46, a developing unit 52, an image transfer unit 54 including a transfer roller 54*a*, and a cleaning unit 56. The printer further includes a fresh toner tank 58 and a waste toner tank 60. A fixing unit 64 and an outlet roller 66 are sequentially arranged in this order downstream of an image transfer station 62 defined by the drum 46 and transfer roller 54*a*. A tray 70 for stacking printings are mounted on a top plate 68 forming the top of the printer 40. The top plate 68 is openable away from the body 42 about a shaft 68*a*.

A sheet feeding device 80 representative of a first embodiment of the present invention is located upstream of the image transfer station 62 in an intended direction of sheet feed. The device 80 sequentially feeds a stack of sheets P one by one and conveys them to the image transfer station 62 without resorting to a registration roller pair. In this sense, the device 80 is similar to the arrangement shown in FIG. 2.

While the drum 46 is in rotation, the main charger 48 charges the surface of the drum 46 uniformly. The optics 50 scans the charged surface of the drum 46 with a laser beam so as to form an electrostatic latent image thereon. The developing unit 52 develops the latent image with toner to thereby form a corresponding toner image. When the toner image is brought to the image transfer station 62, the transfer roller 54*a* transfers it from the drum 46 to the sheet P conveyed by the sheet feeding device 80. The sheet P with the toner image is conveyed to the fixing unit 64 and has the toner image fixed thereby. The sheet or printing P coming out of the fixing unit 64 is driven out to the tray 70 by the outlet roller 66.

Figure 5:
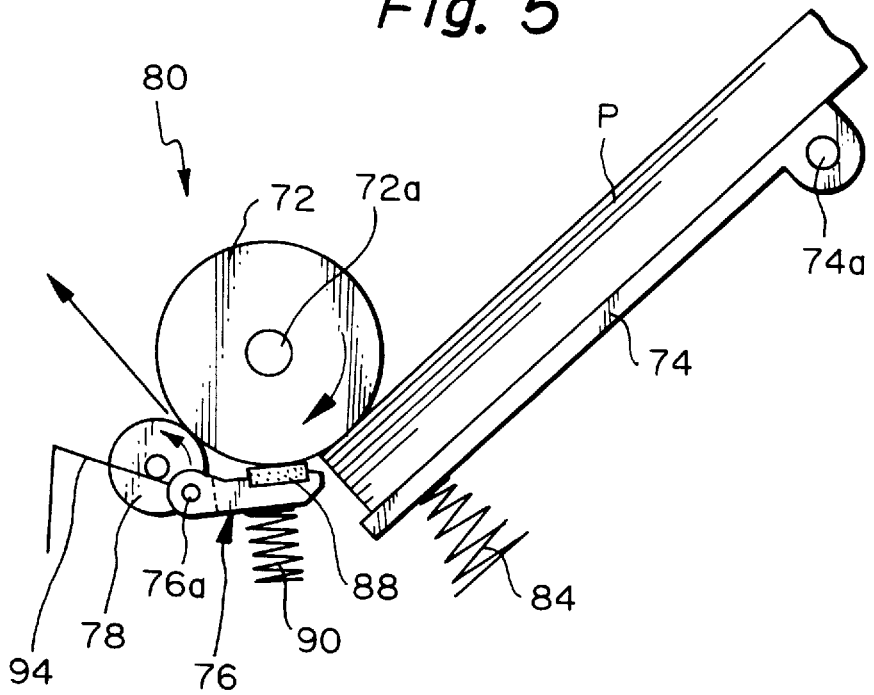
FIG. 5 shows the basic configuration of a sheet feeding device in accordance with the present invention.

Referring to FIG. 5, the sheet feeding device 80 includes a pick-up roller 72 having. substantially the same diameter as the drum 46 and mounted on a shaft 72*a*. The pick-up roller 72 is formed of, e.g., rubber based on EPDM, urethane or silicone and rotatable clockwise together with the shaft 72*a* which is formed of metal or resin. A tray 74 loaded with a stack of sheets P, a separating member or separator 76 and a driven conveyor roller 78 are sequentially arranged around the pick-up roller 72 in this order in the direction of rotation of the roller 72.

Figure 6:
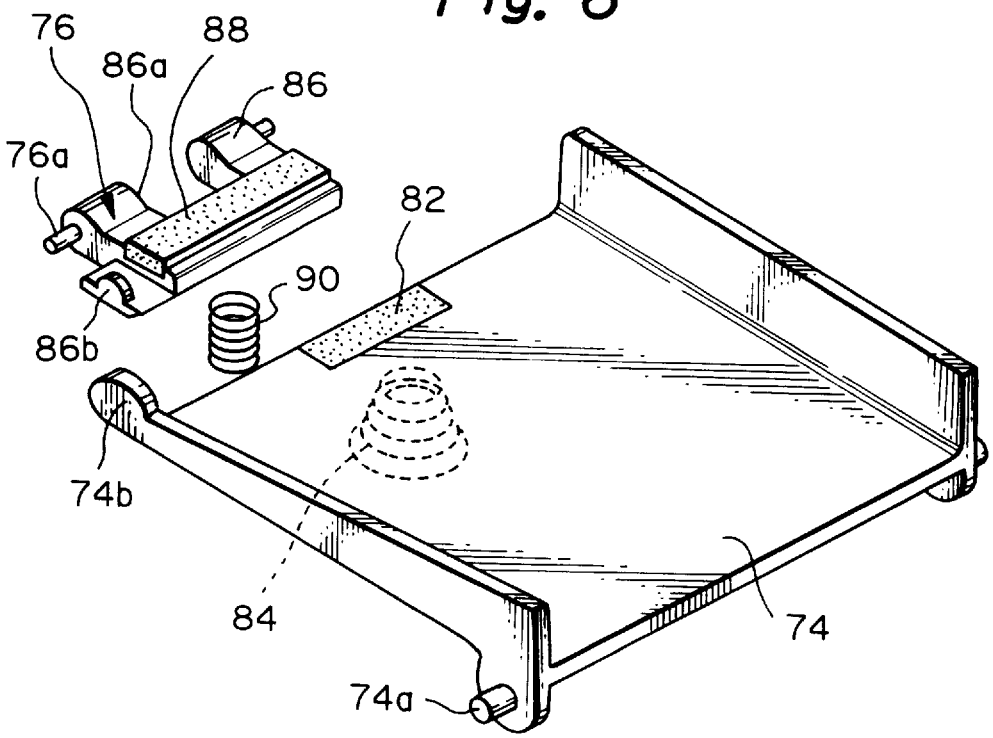
FIG. 6 is an exploded perspective view showing a tray and a separating member together with members adjoining them.

The tray 74 is rotatably mounted on the printer body 42 via a shaft 74*a* and formed of resin. To render the printer 40 compact, the tray 74 is sharply inclined and positioned such that the lower edge of the top sheet of the stack P contacts the pick-up roller 72. The tray 74 is movable up or down in order to bring the lower edge of the top sheet into or out of contact with the pick-up roller 72. As shown in FIG. 6, a pad 82 formed of, e.g., cork or rubber is fitted on the tray 74 at the most downstream side with respect to the sheet feed direction. The most upstream end of the tray 74 in the above direction is simply open. The lower end of the sheet stack P is positioned by an inlet wall, not shown, included in the printer body 42 (see the wall 38 shown in FIG. 3). A compression spring 84 is anchored to the rear of the lower portion of the tray 74 and constantly biases the tray 74 toward the pick-up roller 72.

The separator 76 is positioned downstream of the tray 74 and beneath the pick-up roller 72. The separator 76 is made up of a base 86 rotatable about a fulcrum 76*a* positioned at the downstream side, and a pad 88 formed of cork or rubber. The pad 88 is buried in the upstream portion of the base 86 which is capable of contacting the pick-up roller 72. A notch 86*a* is formed in the downstream portion of the base 86 in order to receive the driven conveyor roller 78. When the separator 76 is rotated about the fulcrum 76*a*, the pad 88 is selectively brought into or out of contact with the pick-up roller 72. A compression spring 90 is anchored to the rear of the separator 76 and constantly biases the separator 76 toward the pick-up roller 72.

Figure 7:
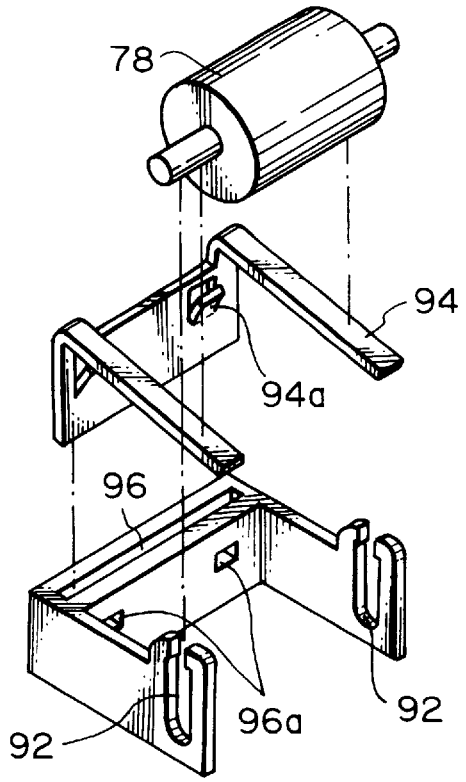
FIG. 7 is an exploded perspective view showing a driven conveyor roller together with members associated therewith.
Figure 8:
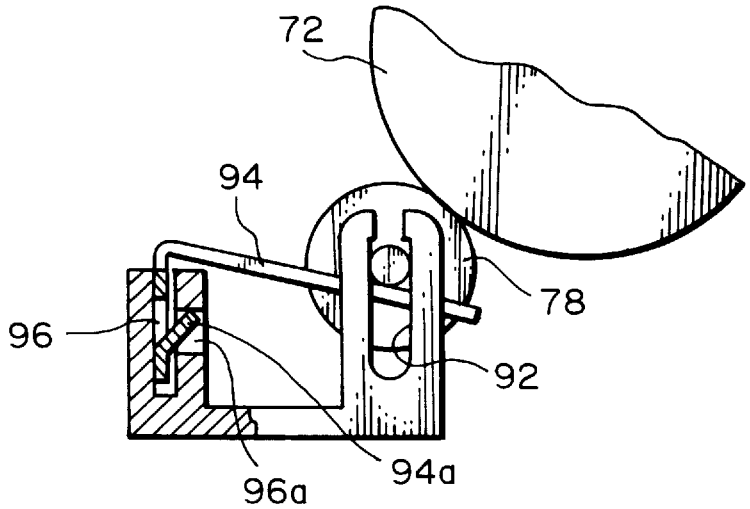
FIG. 8 shows the driven conveyor roller in an position.

As shown in FIGS. 7 and 8, the driven conveyor roller 78 is received in the notch 86*a* of the base 86 and movable up and down, i.e., toward and away from the pick-up roller 72 along U-shaped slits 92 formed in the printer body 42. A leaf spring 94 constantly biases the opposite shaft portions of the conveyor roller 78 upward toward the pick-up roller 72. Specifically, the leaf spring 94 is inserted in a bore 96 formed in the printer body. 42. Pawls 94*a* included in the leaf spring 94 are engaged with holes 96*a* formed in the printer body 42, preventing the spring 94 from slipping out of the printer body 42.

Figure 9:
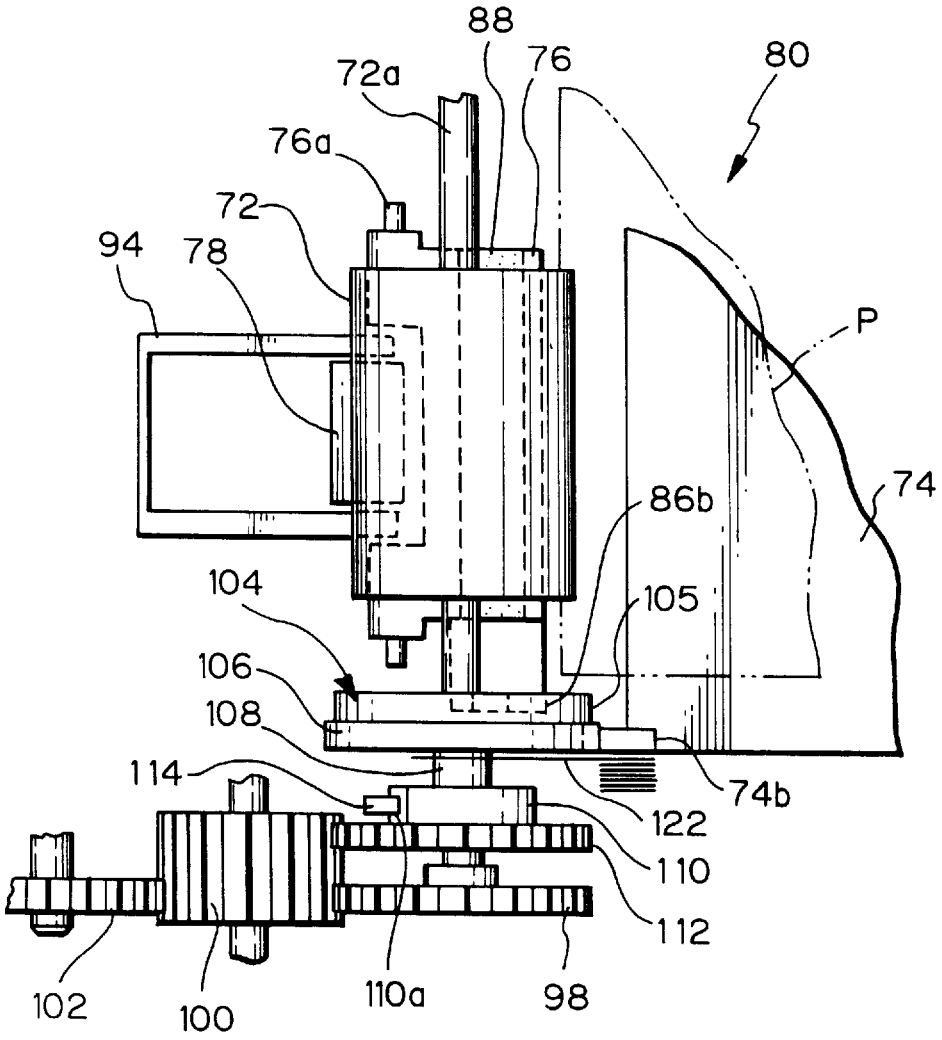
FIG. 9 is a plan view showing a drive transmission system.

As shown in FIG. 9, a drive gear 98 is affixed to a shaft 72*a* on which the pick-up roller 72 is mounted. The drive gear 98 is operatively connected by an idle gear 100 to a drive transmission mechanism 102 which is assigned to the drum 46. In this condition, the pick-up roller 72 is constantly rotated in synchronism with the drum 46.

Figure 10:
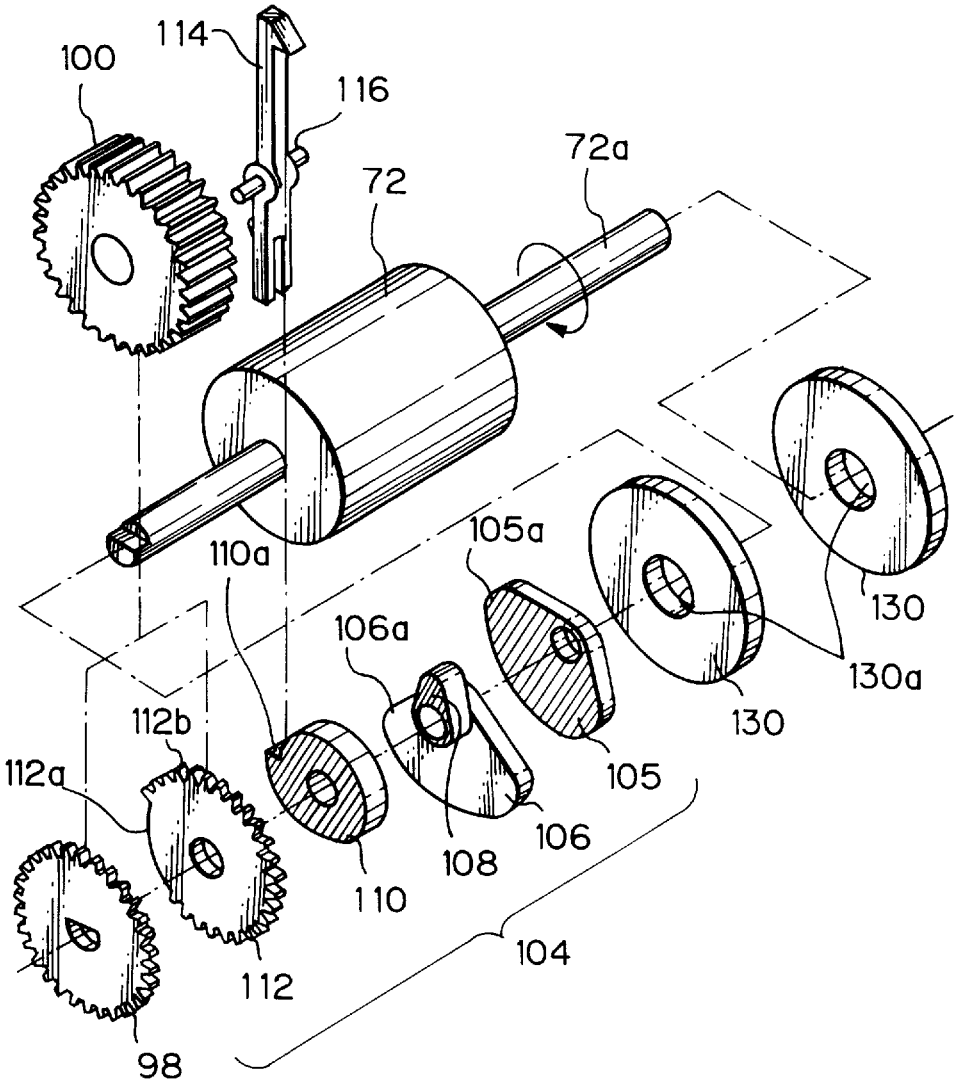
FIG. 10 is an exploded perspective view showing structural elements adjoining a pick-up roller.

While the conveyor roller 78 is held in contact with the pick-up roller 72 at all times, the tray 74 and separator 76 are not done so. A cam 104 causes the tray 74 and separator 76 to selectively contact the pick-up roller 72. The cam 104 is mounted on freely rotatable relative to the shaft 72*a* of the pick-up roller 72. As shown in FIG. 10 in detail, the cam 104 is implemented as an integral assembly of a cam element 105, a cam element 106, an element 108 to be biased, an element 110 to be locked, and a partial gear 112. These constituents are sequentially arranged in the axial direction of the cam 104.

Figure 11:
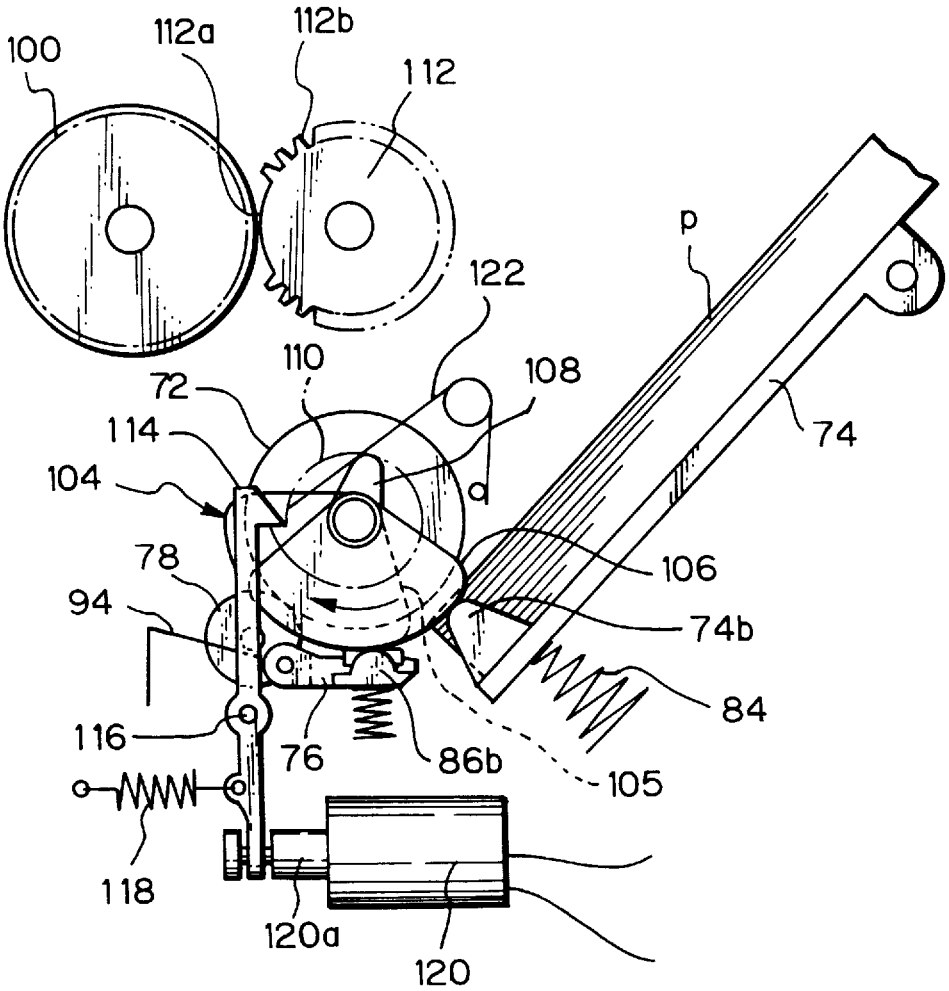
FIG. 11 shows a basic arrangement including the drive transmission mechanism.

The cam element 105 cams the separator 76. A lug 86*b* extends axially from the base 86 of the separator 76 and faces the cam element 105. The cam element 106 cams the tray 74. A lug 74*b* extends from one side of the lower end of the tray 74 and faces the cam element 106. Although the cam elements 105 and 106 are substantially identical in shape, their cam surfaces 105*a* and 106*a* are deviated from each other in the circumferential direction in accordance with the angle between the lugs 86*b* and 74*b*. The partial gear 112 to be rotated by the idle gear 100 includes a toothless portion 112*a*. As shown in FIG. 11, while the printer is out of operation or in a stand-by condition, the cam 104 is so controlled as to maintain the partial gear 112 in a position where the toothless portion 112 faces the idle gear 100, thereby interrupting drive transmission. The element 110 of the cam 104 is used to maintain the partial gear 112 in the above position. For this purpose, a stepped portion or shoulder 110*a* is formed in a predetermined position of the element 110. A lock pawl 114 is freely rotatable about a shaft 116 and constantly biased by a tension spring 118 in a direction in which it abuts against and stops the shoulder 110*a*. A solenoid 120 has a plunger 120*a* connected at one end to a part of the lock pawl 114. When the solenoid 120 is energized, it pulls the plunger 120*a* and thereby releases the lock pawl 114 from the shoulder 110*a*. Further, the element 108 of the cam 104 is constantly biased clockwise by a coil spring 122. When the cam 104 begins to rotate, the element 108 causes the tooth portion 112*b* of the partial gear 112 to mesh with the idle gear 100.

To implement the operation to be described, the biasing forces of the springs 122 and 118 are selected as follows. The force with which the spring 122 biases the element 108 in the conveying direction of the pick-up roller 72 (at the moment when the drive force from the idle gear 100 is lost) is greater than the forces with which the cam elements 15 and 16 respectively press the separator 76 and tray 74 downward. The force with which the solenoid 120 pulls the plunger 120*a* when energized is greater than the force with which the spring 118 tops the lock pawl 114. This force of the spring 118 is, in turn, greater than the force with which the spring 122 biases the element 108 in the conveying direction of the pick-up roller 72.

The sheet feed procedure using the cam 104 will be described with reference to FIGS. 11, 12A–12C, 13A–13C and 14A–14C.

[I] Before Start of Sheet Feed.

Figure 12A:
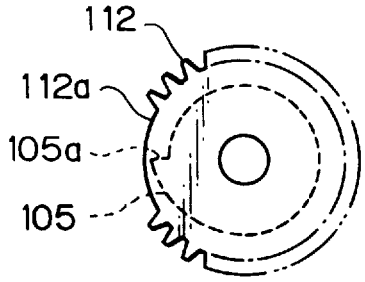
FIGS. 12A–12C show a cam and members adjoining it in a condition before the start of sheet feed.
Figure 12B:
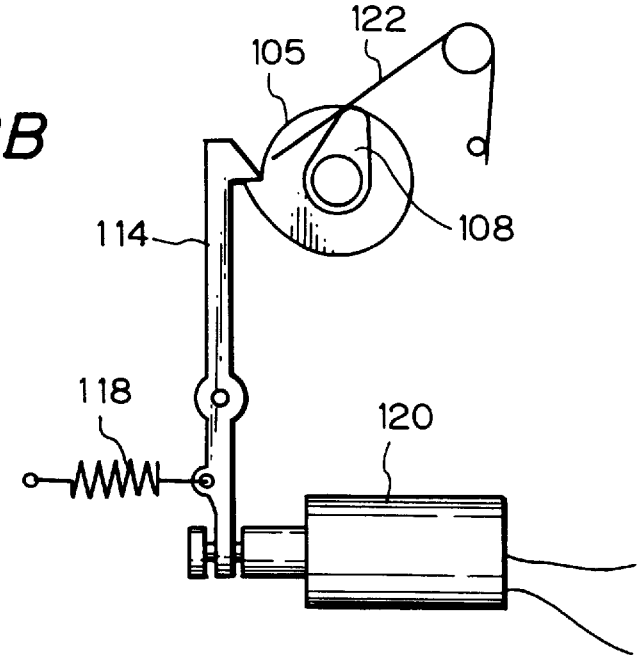
Figure 12C:
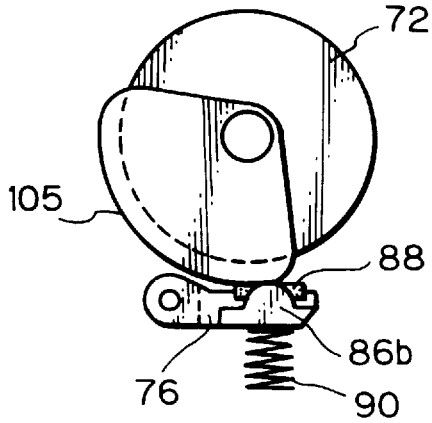

FIGS. 12A–12C show the printer out of operation or in a stand-by condition (home position). Before the start of sheet feed, the image forming section 44 and pick-up roller 72 are held in a halt. As shown in FIG. 12A, the partial gear 112 is held in a halt with its toothless portion 112*a* facing the idle gear 100. The tray 74 and separator 76 are released from the pick-up roller 72. Specifically, as shown in FIG. 12C, the cam surface 105*a* of the cam element 105 abuts against and forces the lug 86*b* of the base 86 downward, thereby releasing the separator 76 from the pick-up roller 72. To release the tray 74 from the pick-up roller 72, the cam surface 106*a* of the cam element 106 abuts against and forces the lug 74*b* downward, although not shown in FIGS. 12A–12C (see FIG. 11). In this condition, the operator can replace or replenish the sheets P with ease.

In the above condition, although the cam 104 itself is biased by the coil spring 122 in the direction of rotation of the pick-up roller 72, the lock pawl 114 stops the shoulder 110*a* of the element 110 (see FIG. 12B). Therefore, the tray 74 and separator 76 are held in their home positions. While the stop pawl 114 is rotatable about the fulcrum 116, it is, in its home position, held in contact with the shoulder 110 by the tension spring 118.

[II] Start of Sheet Feed

The image forming section 44 and pick-up roller 72 start to be driven by a common motor or drive source in synchronism with each other. At this time, the toothless portion 112*a* of the partial gear 112 faces the idle gear 100, preventing the drive force from being transferred from the mechanism 102 to the cam 104. Therefore, the cam 104 remains in a halt, i.e., the rotation of the motor is not transmitted to the cam 104.

In response to a sheet feed start command, the solenoid 120 is energized to pull its plunger 120*a*. This causes the stop pawl 114 to rotate counterclockwise against the action of the tension spring 118. As a result, the stop pawl 114 is released from the shoulder 15*a* (see FIG. 13B) and allows the cam 104 to rotate. The cam 104 starts rotating clockwise due to the action of the coil spring 122 (see FIG. 13B). Consequently, the tooth portion 112*b* of the partial gear 112 starts meshing with the idle gear 100 (see FIG. 13A), causing the cam 104 to be driven by the idle gear 100. That is, the rotation of the cam 104 starts based on the movement of the plunger 120*a* pulled by the solenoid 120.

Figure 13A:
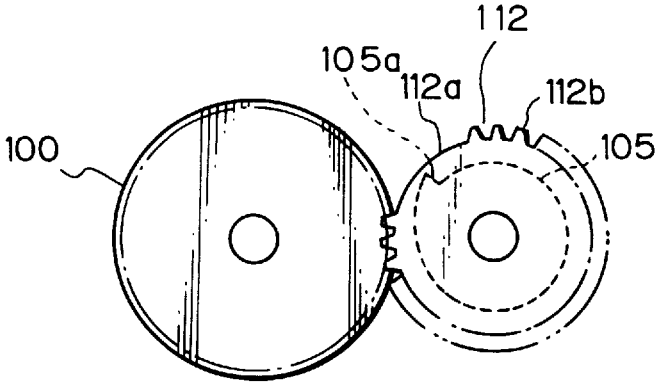
FIGS. 13A–13C show the cam and associated members in a condition to occur on the start of sheet feed.
Figure 13B:
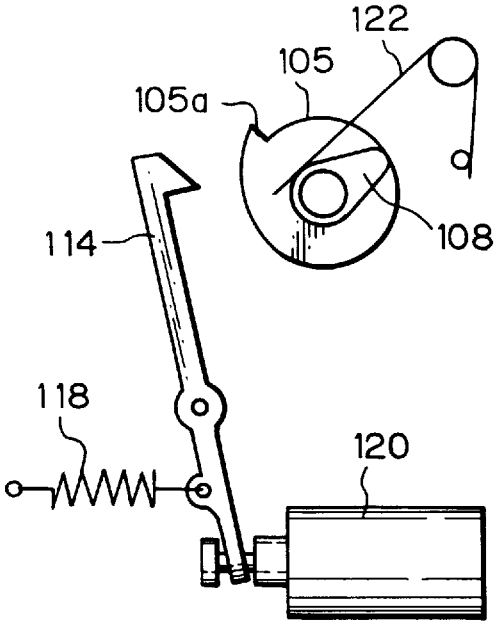
Figure 13C:
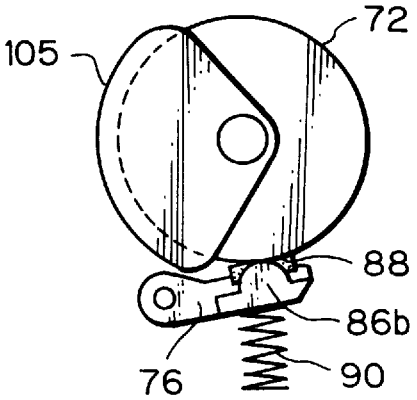

The cam surface 105*a* of the cam element 105 decreases in radius due to the clockwise rotation of the cam 104 and is released from the lug 86*b* of the base 86 of the separator 76 (see FIG. 13C). The separator 76 is therefore brought into contact with the pick-up roller 72 by the compression spring 90. To move the tray 74 toward the pick-up roller 72, the cam surface 106*a* of the cam element 106 decreases in radius and leaves the lug 74*b* of the tray 74, although not shown in FIGS. 13A–13C. Consequently, the tray 74 is pressed against the pick-up roller 72 by the compression spring 84.

By the above procedure, the pad 82 of the tray 74, the pad 88 of the separator 76 and the driven conveyor roller 78 are pressed against the pick-up roller 72 and ready to feed the sheet P. The top sheet P is paid out by the pick-up roller 72 while being separated from the underlying sheets by the roller 72 and pad 88. The separated sheet P reaches the driven conveyor roller 78. Because the pick-up roller 72 is in constant rotation, the sheet P is conveyed by the rollers 72 and 78 toward the image transfer station 62 in synchronism with the rotation of the drum 46.

[III] After Start of Sheet Feed

Figure 14A:
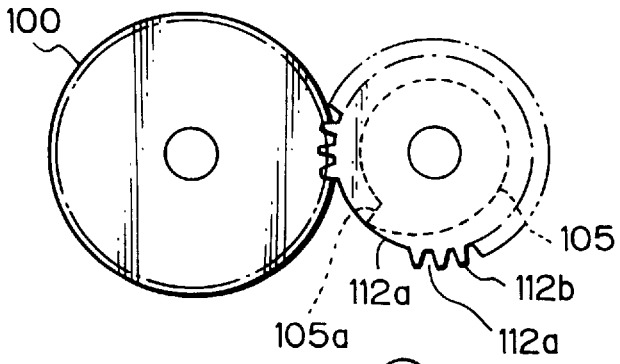
FIGS. 14A–14C show the cam and associated members in a condition after the start of sheet feed.
Figure 14B:
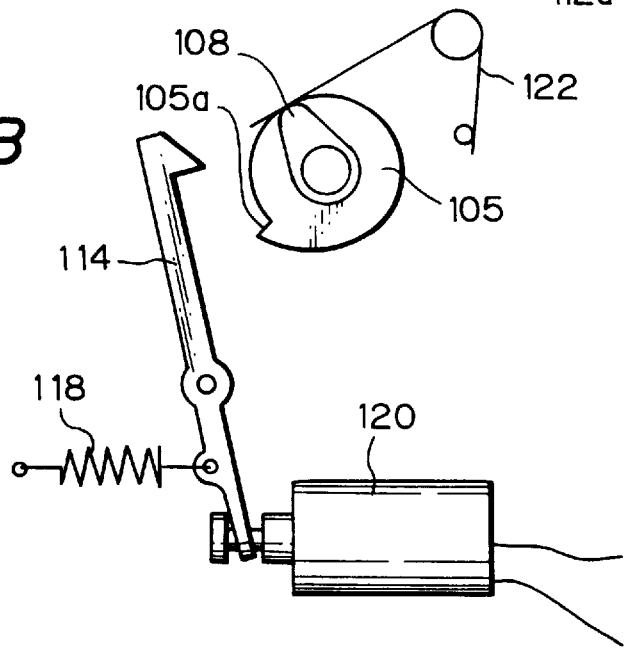
Figure 14C:
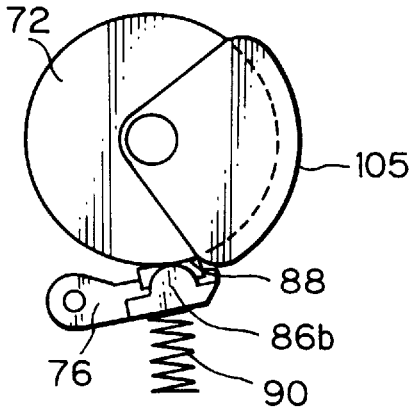

When the leading edge of the sheet P fed by the separator 76 moves slightly away from the conveyor roller 78, the cam 104 is caused to make one full rotation until the toothless portion 112*a* of the partial gear 112 faces the idle gear 100 (see FIG. 14A). This releases the tray 74 and separator 76 from the pick-up roller 72 and thereby frees the conveyance based on the pick-up roller 72 and conveyor roll 78 from the loads ascribable thereto. Specifically, when the leading edge of the sheet P reaches the nip between the pick-up roller 72 and the conveyor roller 78, the cam portions 105*a* and 106*a* of the cam elements 105 and 106 respectively press the lugs 86*a* and 74*b* downward. Consequently, the tray 74 and separator 76 are released from the pick-up roller 72 against the action of the springs 90 and 84, respectively. In this condition, the sheet P is conveyed to the image transfer station 62 by the pick-up roller 72 and conveyor roller 78. In this manner, the pads 82 and 88 do not exert loads on the conveyance of the sheet P effected by the rollers 72 and 78.

When the cam 104 is further rotated until the toothless portion 112*a* of the partial gear 112 faces the idle gear 100, the drive transmission from the idle gear 100 is interrupted with the result that the cam 104 stops rotating. At this instant, however, the cam 104 continuously rotates in the direction of rotation of the pick-up roller 72 due to the action of the coil spring 122. During the course of this rotation of the cam 104, the lock pawl 114 abuts against the shoulder 110*a* of the element 110 due to the action of the tension spring 118. As a result, the cam 104 is fully brought to a stop. This again sets up the conditions described in the item [I]. However, because the sheet feed operation is under way, the pick-up roller 72 is continuously driven by the motor via the drive transmission mechanism 102 and idle gear 100. After the trailing edge of the sheet P has moved away from the pick-up roller 72 and conveyor roller 78, the next sheet P begins to be paid out in a preselected period of time. If the sheet feed operation should not be repeated, the motor is continuously driven at least until the sheet P moves away from the outlet roller 66.

Figure 15A:
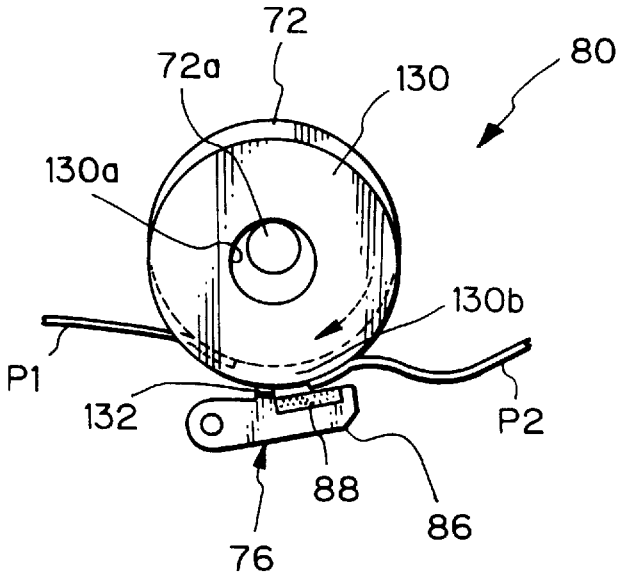
FIGS. 15A and 15B are fragmentary views showing a first embodiment of the sheet feeding device in accordance with the present invention.
Figure 15B:
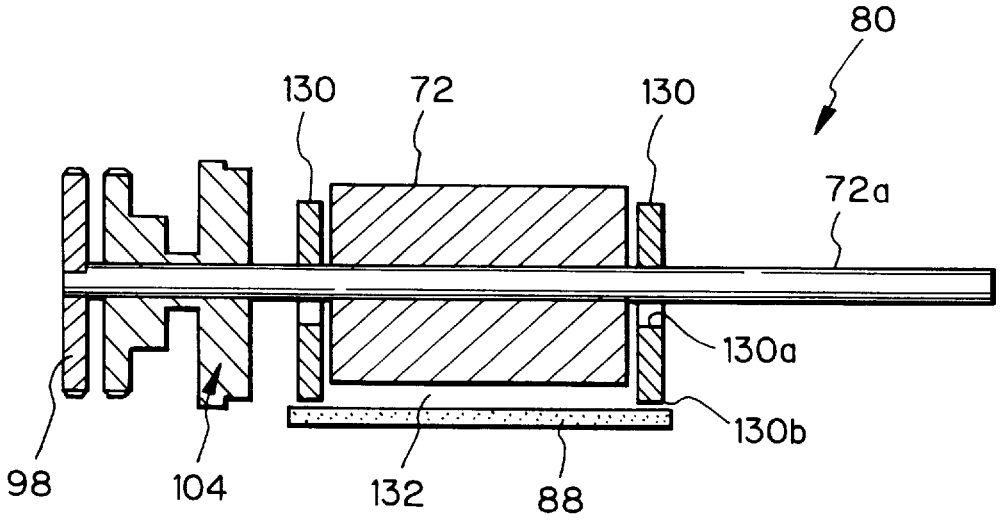

As shown in FIGS. 10, 15A and 15B, a pair of resin rollers or regulating members 130 are respectively mounted on the opposite ends of the shaft 72*a* of the pick-up roller 72. The rollers 130 are positioned at opposite sides of the range over which the pick-up roller 72 is capable of contacting the separator 76, and each has a slightly greater diameter than the pick-up roller 72. The rollers 130 are each formed with a circular center hole 130*a* slightly greater in diameter than the shaft 72*a*. Therefore, the rollers 130 are freely rotatable and movable up and down relative to the shaft 72*a*. When the separator 76 is pressed against the pick-up roller 72, the rollers 130 are raised by the separator 76. When the separator 76 is lowered, the rollers 130 are also lowered and hang down from the shaft 72*a*. The downward displacement of the rollers 130 is equal to the difference in diameter between the shaft 72*a* and the circular holes 130*a*.

When the pad 88 of the separator 76 is pressed against the pick-up roller 72 for feeding the top sheet P, it raises the rollers 130 and prevents them from interfering with the separation and feed of the sheet P1. When the leading edge of the sheet P1 reaches the conveyor roller 78, the separator 76 is urged away from the pick-up roller 72 by the cam element 105. As a result, an open path 132 is formed between the pick-up roller 72 and the separator 76. At this instant, the rollers 130 fall due to their own weight in interlocked relation to the separator 76. As shown in FIGS. 15A and 15B, the bottoms of the rollers 130 protrude into the open path 132 and thereby reduce the width of the path 132. Consequently, even if the top sheet P2 remaining after the feed of the sheet P1 tends to slip onto the separator 76, it abuts against the bottoms 130*b* of the rollers 130. This prevents the accidental continuous feed of the sheets P1 and P2.

The rollers 130 may be replaced with cam-like sectorial members, if desired.

Figure 16A:
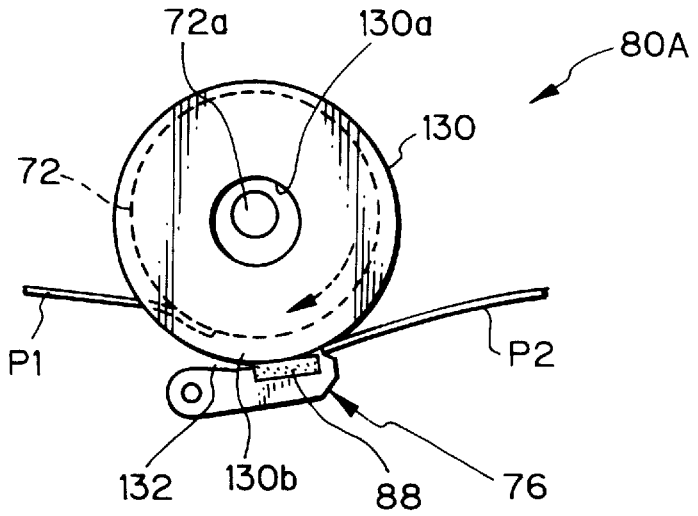
FIGS. 16A and 16B are fragmentary views showing a second embodiment of the present invention.
Figure 16B:
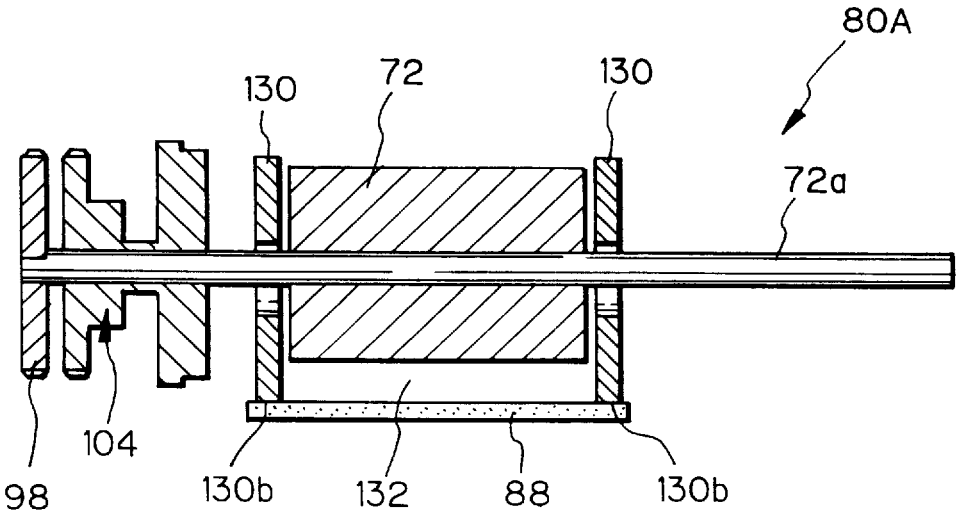

FIGS. 16A and 16B show a sheet feeding device 80A representative of a second embodiment of the present invention. In FIGS. 16A and 16B, the same constituent parts as the parts shown in FIGS. 15A and 15B are designated by the same reference numerals, and a detailed description thereof will not be made in order to avoid redundancy. This is also true with other embodiments to be described later.

As shown, in the device 80A, the holes 130*a* of the rollers 130 or the rollers 130 themselves have a diameter great enough for the bottoms 130*b* of the rollers 130 to contact the pad 88 when the separator 76 is released from the pick-up roller 72. That is, the bottoms 130*b* of the rollers 130 remain in contact with the pad 88 without regard to the position of the separator 76.

In the illustrative embodiment, when the leading edge of the top sheet P reaches the conveyor roller 78, the separator 76 is released from the pick-up roller 72 by the cam element 105, again forming the open path 132. At this instant, the rollers 130 fall due to their own weight until their bottoms 130*b* contact the pad 88, delimiting the path 132 in a wedge-like configuration, as shown in FIGS. 16A and 16B. Therefore, even if the sheet P2 left after the feed of the sheet P1 tends to slip onto the separator 76, it simply abuts against the bottoms 130*b* of the rollers 130 protruding into the path 132. The device 80A therefore obviates the accidental continuous feed more surely than the device 80 shown in FIGS. 15A and 15B.

Figure 17A:
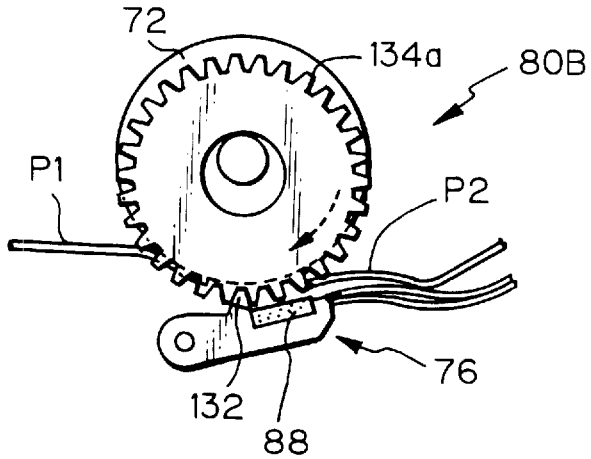
FIGS. 17A and 17B are fragmentary views showing a third embodiment of the present invention.
Figure 17B:
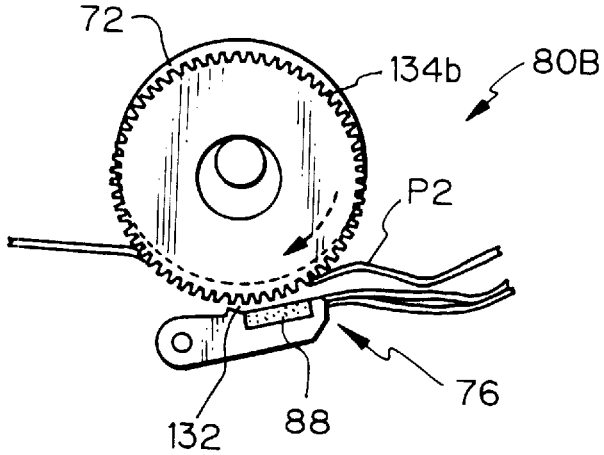

FIGS. 17A and 17B show a sheet feeding device 80B representative of a third embodiment of the representative invention. As shown, in the device 80B, the rollers 130 each has an irregular circumferential surface 134. The irregular surface 134 may be implemented as a spur gear 134*a*, as shown in FIG. 17A, or as a knurled surface 134*b*, as shown in FIG. 17B. In this configuration, when the sheet P2 left after the feed of the sheet P1 tends to slip onto the separator 76, it simply abuts against the irregular surfaces 134*a* or 134*b* of the rollers 130. In addition, when the leading edge of the sheet P2 is caught by the recesses of the irregular surfaces 134*a* or 134*b*, the accidental continuous feed is more surely obviated.

While the device 80B is shown as including the rollers 130 shown in FIGS. 15A and 15B, it is similarly practicable with the rollers 130 shown in FIGS. 16A and 16B.

Figure 18:
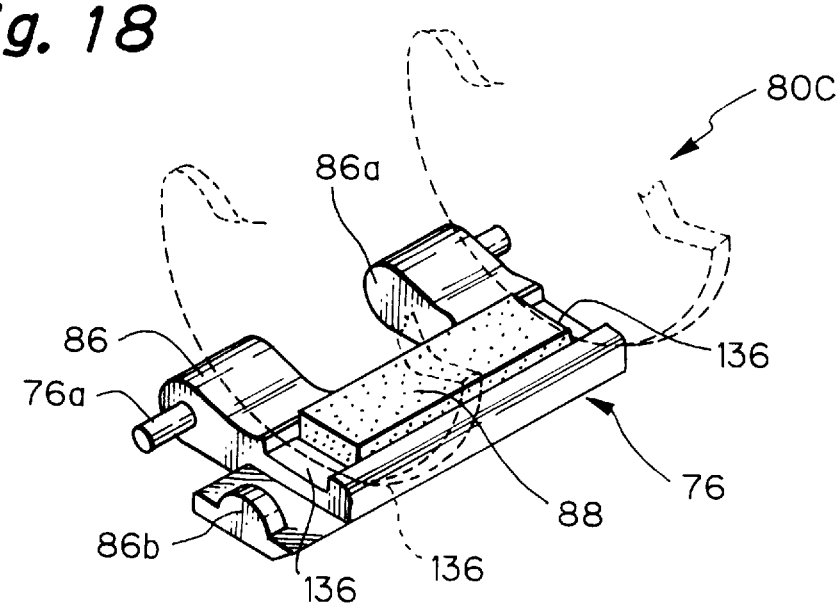
FIGS. 18–20 are fragmentary views showing a fourth embodiment of the present invention.
Figure 19:
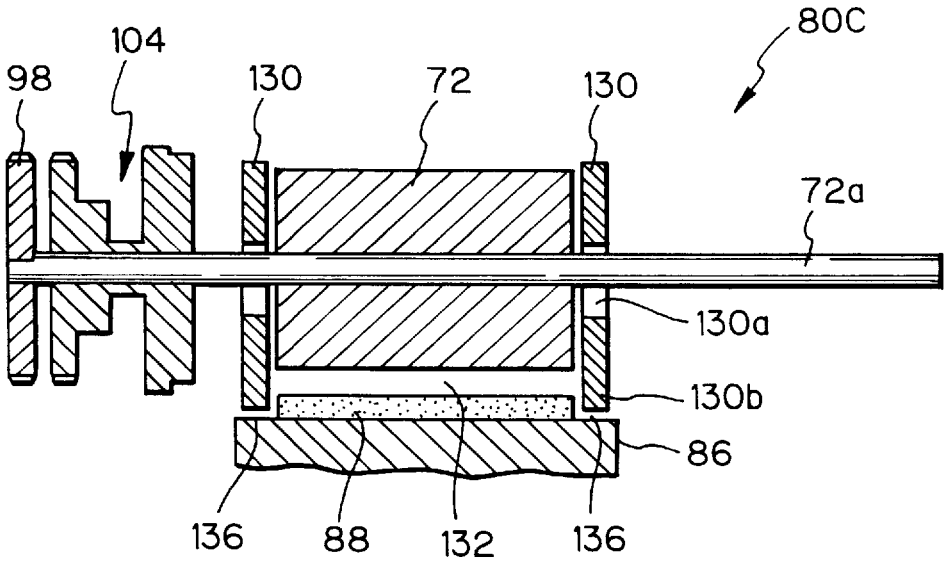
Figure 20:
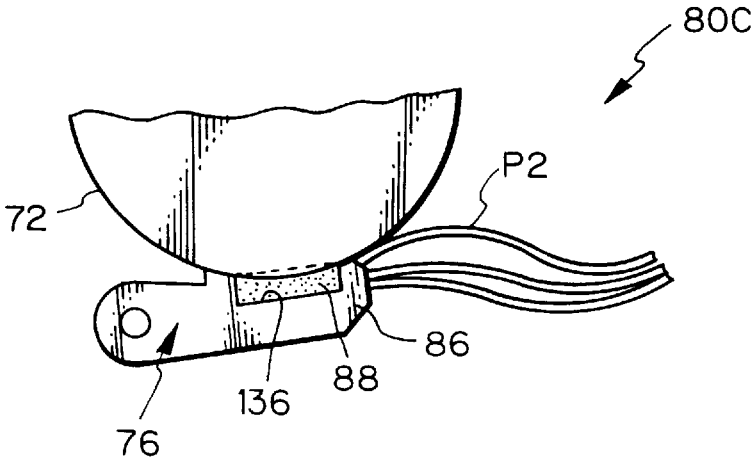

FIGS. 18–20 show a sheet feeding device 80C representative of a fourth embodiment of the present invention. As shown, the base 86 of the separator 76 is formed with recesses 136 in its portions corresponding to the rollers 130. The rollers 130 fall into the recesses 136 when lowered due to their own weight, as stated earlier. The recesses 136 are formed by removing the opposite ends of the pad 88. The hole 130*a* of each roller 130 is provided with a relatively large diameter in order to increase the downward displacement of the roller 130.

In the above device 80C, when the separator 76 is released from the pick-up roller 72, the rollers 130 fall due to their own weight until their bottoms 130*b* rest on the bottoms of the recesses 136, as shown in FIG. 20. In this condition, the rollers 130 form walls delimiting the path 132 and stop the leading edge of the sheet P2 tending to slip down onto the separator 76. This obviates the accidental continuous feed more surely than the previous embodiments.

Figure 21:
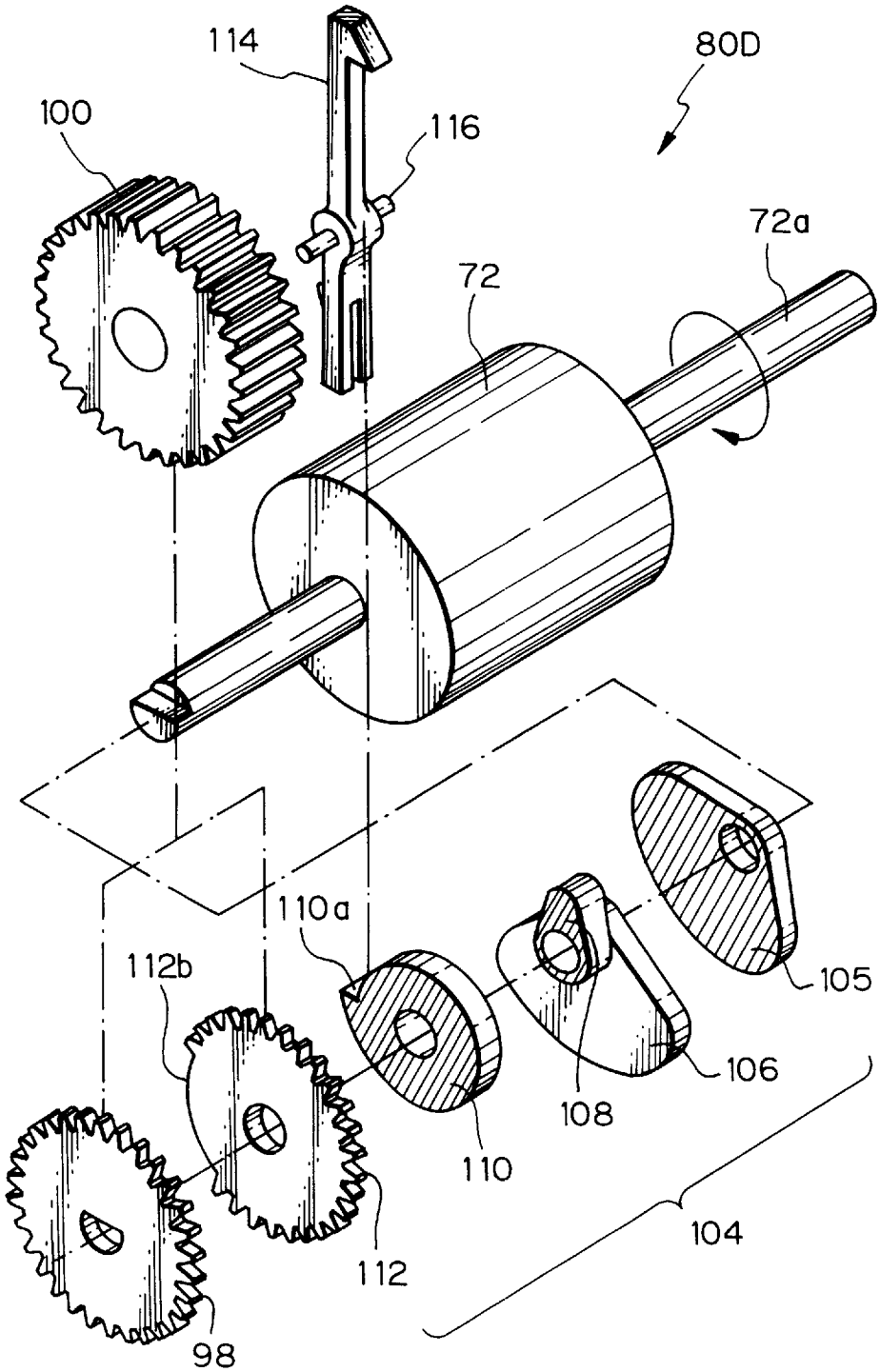
FIG. 21 is an exploded perspective view showing a fifth embodiment of the present invention.
Figure 22:
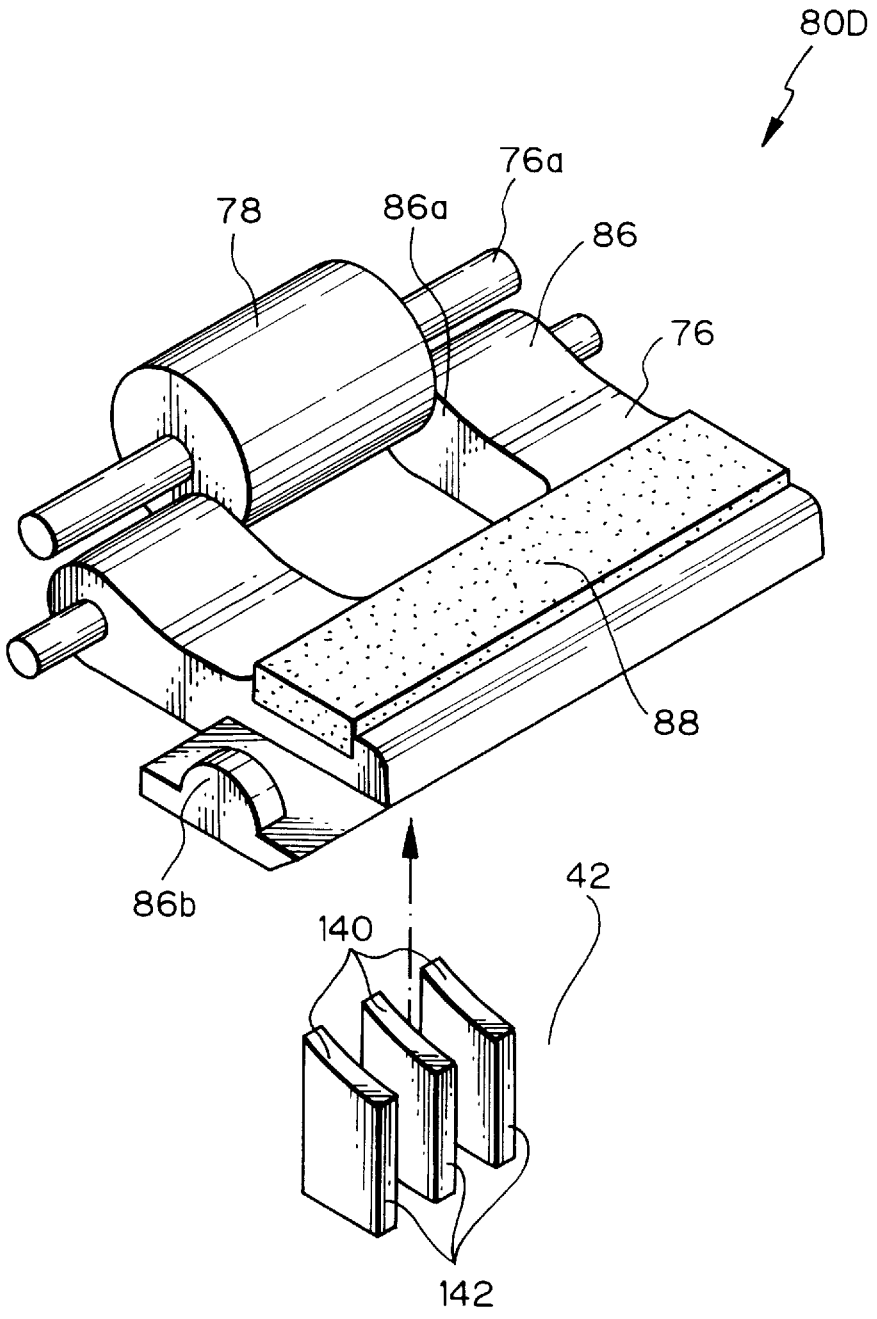
FIG. 22 is an exploded perspective view showing a separating member included in the fifth embodiment together with members associated therewith.

FIGS. 21, 22, 23A and 23B show a sheet feeding device 80D representative of a fifth embodiment of the present invention. As shown, the device 80D does not include the rollers 130 and has the shaft 72*a* of the pick-up roller 72 configured as shown in FIG. 21. A sheet transport path 138 extends from the separator 76 to the driven conveyor roller 78 and is formed by a guide member 140. The guide member 140 is formed integrally with the bottom of the printer body 2 and configured as three ribs. The transport path 138 noticeably varies in direction between the separator 76 and the conveyor roller 78. The guide member 140 is so configured as to make the transport path 138 between the separator 76 and the conveyor roller 78 complementary to the circumferential surface of the pick-up roller 72, so that the sheet can be smoothly conveyed from the separator 76 to the roller 78. The guide member 140 protrudes from the notched portion 86*a* of the base 86 of the separator 76.

The upright edges of the guide member 140 located at the upstream side in the direction of sheet feed constitute stop walls or regulating members 142. The stop walls 142 have such a height that the walls 142 are hidden below the conveying surface 144 of the separator 76 when the separator 76 is pressed against the pick-up roller 72, but caused to protrude above the surface 144 when the separator 76 is released from the roller 72. That is, the stop walls 142 are so positioned as to exist in the open path 132 when the separator 76 is released from the pick-up roller 72.

Figure 23A:
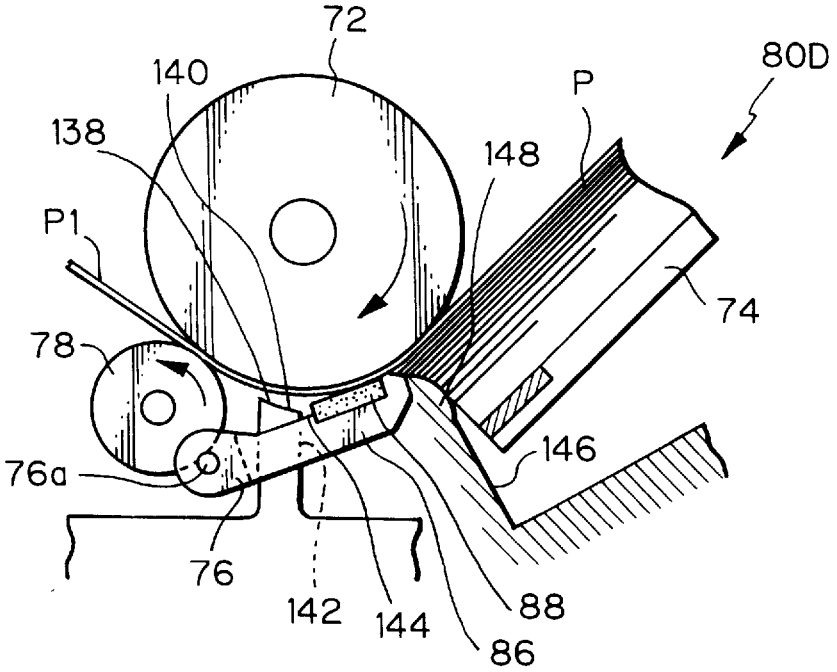
FIGS. 23A and 23B each shows the separating member of FIG. 22 in a particular position.

As shown in FIG. 23A, when the pad 88 of the separator 76 is pressed against the pick-up roller 72 for feeding the sheet P1, the stop walls 142 are hidden below the conveying surface 144 of the separator 76. Therefore, the stop walls 142 do not interfere with the sheet P1 being conveyed toward the conveyor roller 78 by the pad 88 and pick-up roller 72. At this instant, because the transport path 138 is complementary in configuration to the periphery of the pick-up roller 72 due to the guide member 140, the sheet P1 can be smoothly driven toward the conveyor roller 78.

Figure 23B:
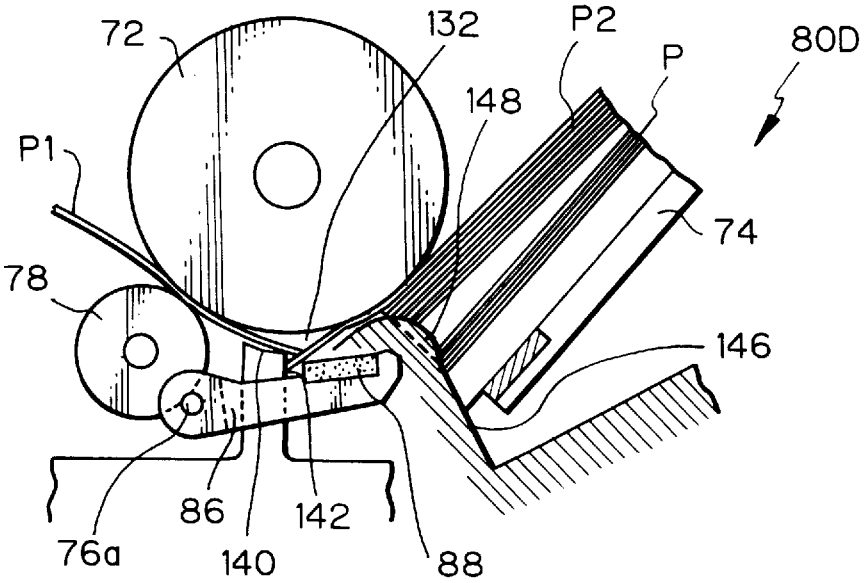

When the leading edge of the sheet P1 reaches the conveyor roller 78, the separator 76 is released from the pick-up roller 72 by the cam element 105. As a result, the open path 132 is formed between the pick-up roller 72 and the separator 76. As shown in FIG. 23B, the stop walls 142 protrude from the surface 144 of the separator 76 due to the fall of the separator 144. Therefore, even when the sheet P2 left after the feed of the sheet P1 tends to slip down onto the separator 76, it simply abuts against the stop walls 142 now existing in the transport path 132. Particularly, when the sheet P2 contacts the pick-up roller 72 and is about to be conveyed thereby, it tends to be conveyed in the tangential direction from the contact point (leftward downward in the figures). This can be surely eliminated with a simple construction because the stop walls 142 are positioned in the above tangential direction. Moreover, the stop walls 142 formed integrally with the printer body 42 further enhance the elimination of the accidental continuous feed, compared to the roller 130 scheme.

The stop walls 142 unitary with the printer body 42 and with the guide member 140 do not increase the number of parts, and in addition position the sheet P2 with high accuracy.

The first to fifth embodiments shown and described have the following advantages.

(1) A tray, a separator and a driven conveyor roller are sequentially arranged around a single pick-up roller. A regulating member does not interfere with a sheet transport path when the separator is in operation, but exists in an open path in order to stop the following sheet when the separator is out of operation. After the top sheet paid out from the tray has been separated from the underlying sheets by the separator, the tray and separator are released from the pick-up roller by bias cancelling means, forming the open path. Even in this condition, the regulating member interferes with the following sheet left on the separator and thereby avoids accidental continuous feed.

(2) The regulating member is implemented as rollers mounted on the shaft of the pick-up roller and rotatable and movable up and down relative to the shaft. When the separator is released from the pick-up roller, the rollers fall due to their own weight and partly exist in the open path. Therefore, the accidental continuous feed can be obviated by a simple arrangement.

(3) The rollers fall due to their own weight until they contact the separator. The rollers brought into contact with the separator delimit the open path in a wedge-like configuration. This substantially prevents the following sheet from passing under the rollers.

(4) The rollers are each provided with an irregular circumferential surface. When the separator is released from the pick-up roller, the rollers brake the following sheet with their irregular surfaces and more surely obviates the accidental continuous feed.

(5) The separator is formed with recesses for receiving the rollers when the rollers fall to obstruct the open path. In this condition, the rollers form stop walls which successfully obviate the accidental continuous feed.

(6) The regulating member is implemented as stop walls protruding from the apparatus body toward a transport path around the pick-up roller. The stop walls are hidden below the conveying surface of the separator when the separator is in operation, but caused to protrude from the above surface when the separator is out of operation. The regulating member does not increase the number of parts and obviates the accidental continuous feed with an extremely simple configuration.

(7) The stop walls are formed integrally with a guide member which forms a guide path between the separator and the driven roller, further simplifying the measure against the accidental continuous feed.

Figure 24:
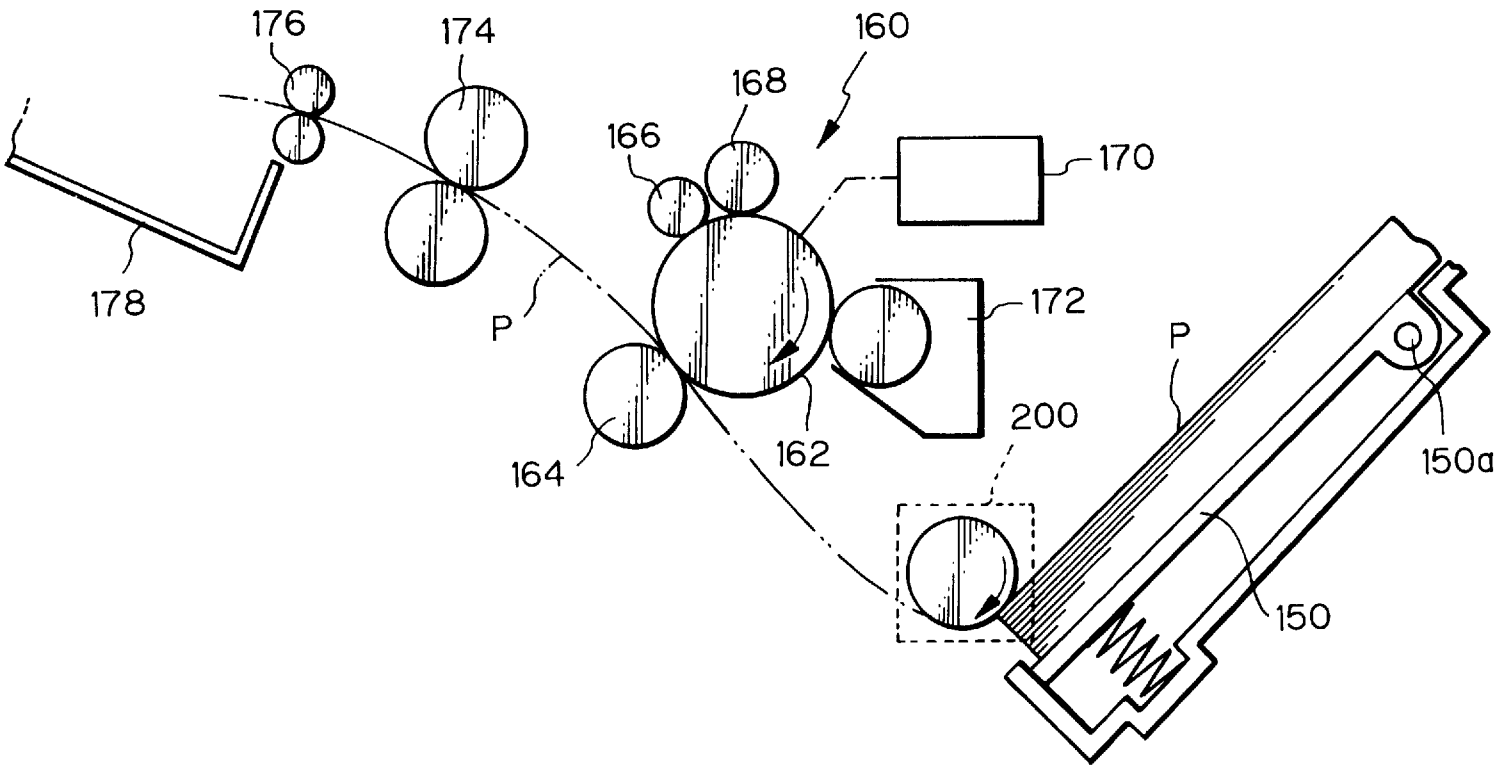
FIG. 24 shows a printer to which a sixth to a tenth embodiment of the present invention are applicable.

A sixth to a tenth embodiment of the present invention will be described hereinafter. FIG. 24 shows a printer as a specific form of an image forming apparatus to which the embodiments to be described are applicable.

As shown in FIG. 24, the printer includes a tray 150 loaded with a stack of sheets P and rotatable about a shaft 150*a*, and a sheet feeding device 200. An image forming unit 160 is located downstream of the sheet feeding device 200 in an intended direction of sheet feed and defines an image forming station. The image forming unit 160 has a photoconductive drum 162, a transfer charger 164 for transferring a toner image from the drum 162 to the sheet P, a cleaning section 166 for removing toner remaining on the drum 162 after image transfer, a main charger 168 for charging the drum 162 uniformly, optics 170 for scanning the drum 162 with a laser beam L to thereby form a latent image on the drum 162, and a developing section 172 for developing the latent image with toner. A fixing unit 174 is positioned downstream of the transfer charger 164 in order to fix the toner image on the sheet P. An outlet roller 176 drives the sheet or printing P coming out of the fixing unit 174 out of the printer to a tray 178.

Figure 25:
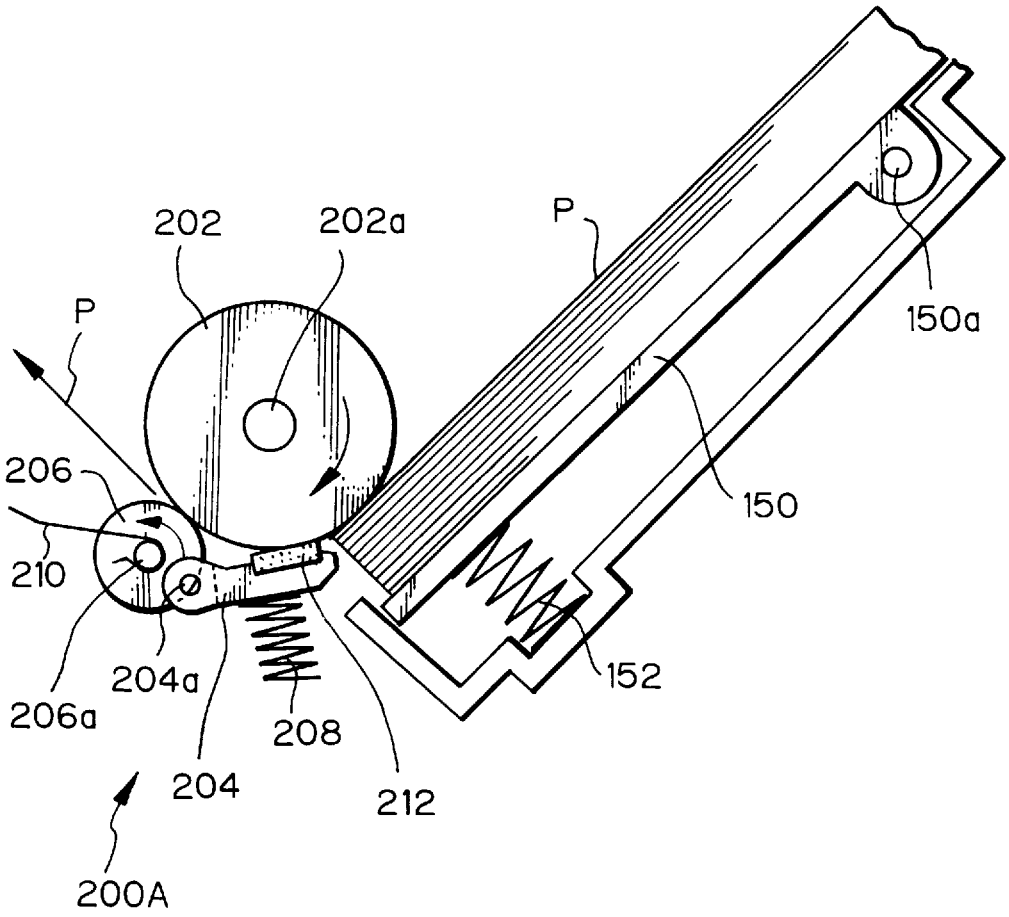
FIG. 25 shows a sixth embodiment of the present invention.

FIG. 25 shows the sheet feeding device 200 representative of a sixth embodiment of the present invention in detail. As shown, a separator 204 and a driven conveyor roller 206 are pressed against a pick-up roller 202. The tray 150 is constantly biased upward by a spring 152 such that the top sheet P of the tray 150 is pressed against the pick-up roller 202. The separator 204 and conveyor roller 206 are pressed against the pick-up roller 202 by springs 208 and 210, respectively. The pick-up roller 202 is formed of rubber based on, e.g., EPDM, urethane or silicone and mounted on a shaft 202*a* formed of metal or hard resin. A pad 212, formed of, e.g., rubber or cork is fitted on one end of the separator 204 capable of contacting the pick-up roller 202. The separator 204 is rotatable about a shaft 204*a*. The conveyor roller 206 is formed of resin. A leaf spring 210 is anchored to the shaft 206*a* at one end thereof.

In operation, when the pick-up roller 202 is driven, it pays out the top sheet P from the tray 150 toward the separator 204 due to friction acting between the roller 202 and the sheet P. So long as a single sheet P is paid out from the tray 150, it is conveyed by the pick-up roller 202 via the pad 212 of the separator 204. On the other hand, when a plurality of sheets P are accidentally paid out together, the pad 212 causes friction greater than the friction between the sheets P to act between the pad 212 and the sheet P adjoining the pad 212. As a result, only the top sheet P adjoining the pick-up roller 202 is conveyed toward the conveyor roller 206. The pick-up roller 202 pays out the sheet P from the tray 150 in synchronism with a drive section, not shown, assigned to the image forming unit 160. Then, the roller 202 conveys the sheet P toward the nip between the drum 168 and the transfer charger 164 in cooperation with the conveyor roller 206.

As stated above, the conveyor roller 206 is a driven roller pressed against the pick-up roller 202 and driven on the basis of friction. The embodiment therefore does not need exclusive drive means for driving the conveyor roller 206, and is therefore simple is construction. In addition, the pick-up roller 202, conveyor roller 206 and separator 204, as well as their connecting members, can be constructed into a single unit.

Figure 26:
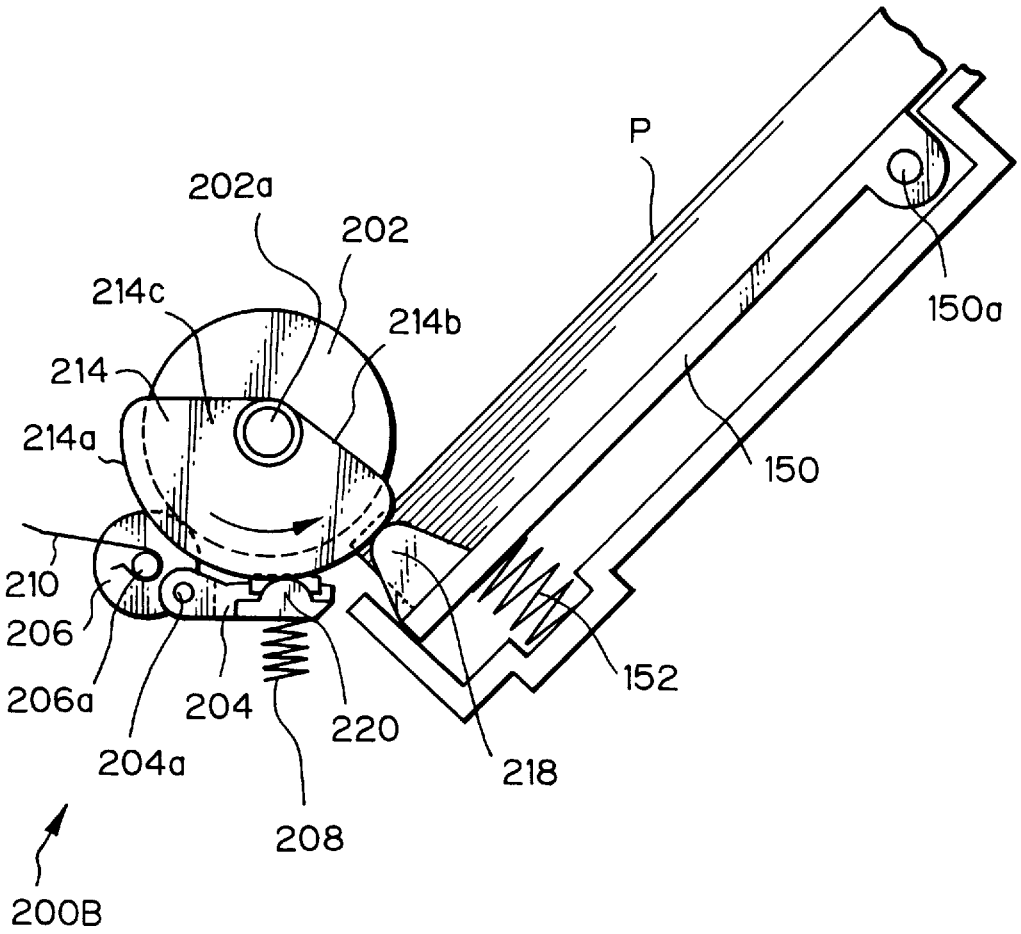
FIGS. 26 and 27 show a seventh embodiment of the present invention.
Figure 27:
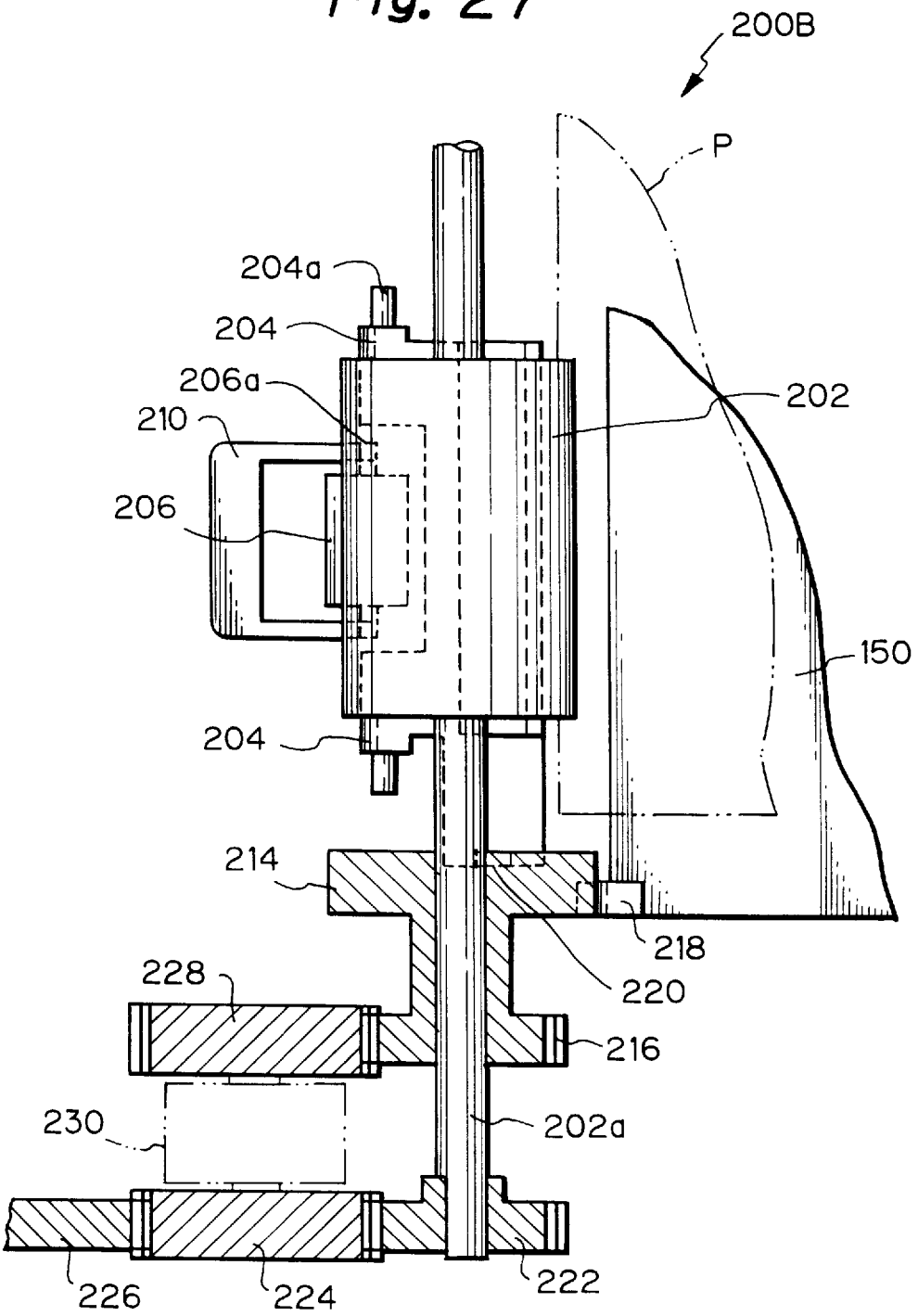

FIGS. 26 and 27 show a sheet feeding device 200B representative of a seventh embodiment of the present invention. In FIGS. 26 and 27, the same structural elements as the elements shown in FIGS. 24 and 25 are designated by the same reference numerals, and a detailed description thereof will not be made in order to avoid redundancy. As shown, an eccentric cam 214 is mounted on and rotatable relative to the shaft 202*a* of the pick-up roller 202. The eccentric cam 214 includes a gear portion 216. Specifically, the cam 214 has a larger diameter portion 214*a* and a first and a second smaller diameter portion 214*b* and 214*c*, respectively. A lug 218 protrudes from one side of the front end of the tray 150 with respect to the sheet feed direction. Likewise, a lug 220 protrudes from one side of the separator 204. The larger diameter portion 214*a* presses the lugs 218 and 220 downward against the biasing forces acting thereon. The smaller diameter portions 214*b* and 214*c* respectively release the lugs 218 and 220, allowing the tray 150 and separator 204 to rise due to the biasing forces.

A gear 222 is affixed to one end of the shaft 202*a* of the pick-up roller 202. An idle gear 224 is held in mesh with the gear 222 and driven by a drive transmission mechanism 226. The mechanism 226 constitutes a drive section assigned to the image forming unit 160. A transmission gear 228 is held in mesh with the gear portion 216 of the eccentric cam 214. A drive switching section, or cam drive control section, 230 selectively brings the transmission gear 228 into mesh with the idle gear 224. In the illustrative embodiment, the switching section 230 is implemented by a sort of clutch mechanism. As shown in FIG. 26, when the printer is out of operation of in a stand-by condition, the cam 214 is held in its home position where its larger diameter portion 214*a* presses the lugs 218 and 220 downward.

While the cam 214 is held in its home position, the top sheet P of the tray 150 and the pad 212 of the separator 204 are spaced from the pick-up roller 202. When a controller, not shown, built in the printer generates a sheet feed start command, the drive transmission mechanism 226 causes the gear 222 of the shaft 202*a* to rotate via the idle gear 224. As a result, the pick-up roller 202 is rotated clockwise. Substantially at the same time, the cam 214 is rotated clockwise by the mechanism 226 via the idle gear 224, switching section 230, gear 228, and gear portion 216.

On the rotation of the cam 214, the larger diameter portion 214*a* releases the lugs 218 and 220 of the tray 150 and separator 204. As a result, the tray 150 and separator 204 are raised by the springs 152 and 208. Hence, the top sheet P of the tray 150 and the pad 212 of the separator 204 are pressed against the pick-up roller 202. The pick-up roller 202 in rotation pays out the top sheet P from the tray 150. When the leading edge of the sheet P moves away from the nip between the pick-up roller 202 and the conveyor roller 206, the switching section 230 interrupts the drive transmission to the gear 228. Consequently, the cam 202 is brought to a stop with the larger diameter portion 214*a* pressing the lugs 218 and 220 downward, as shown in FIG. 26. In this condition, the top sheet P and the pad 212 of the separator 204 are spaced from the pick-up roller 202, reducing the load acting on the paper P in transport.

When only one sheet P is to be fed, the pick-up roller 202 is continuously rotated until the sheet P is handed over to a conveyor system included in the image forming unit 160. During this period of time, the switching section 230 controls one rotation of the cam 214. When two or more sheets P are to be continuously fed, the pick-up roller 202 is continuously rotated while the cam 214 repeats its rotation under the control of the switching section 230. In this case, the cam 214 is brought to a stop at the previously mentioned home position at all times.

An arrangement may be made such that the switching section 230 receives a driving force from a motor or similar exclusive drive means in place of the shared drive transmission mechanism 226.

Figure 28:
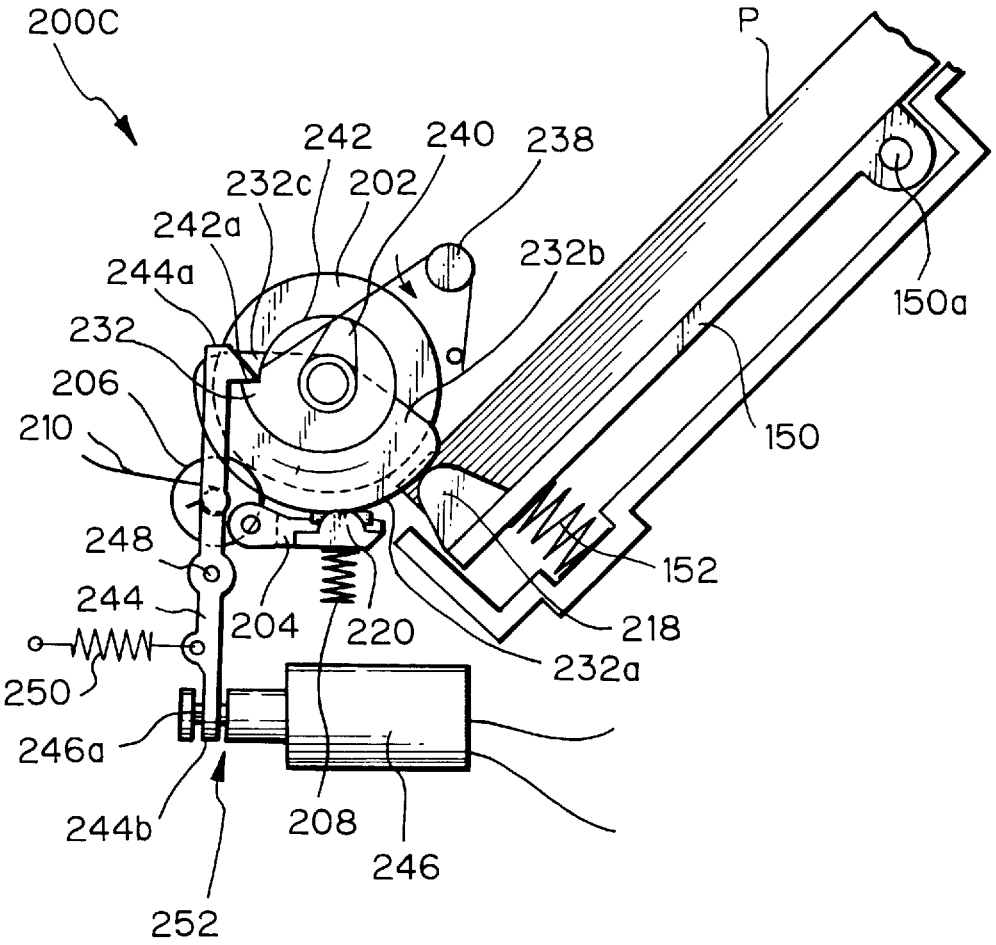
FIGS. 28 and 29 show an eighth embodiment of the present invention.
Figure 29:
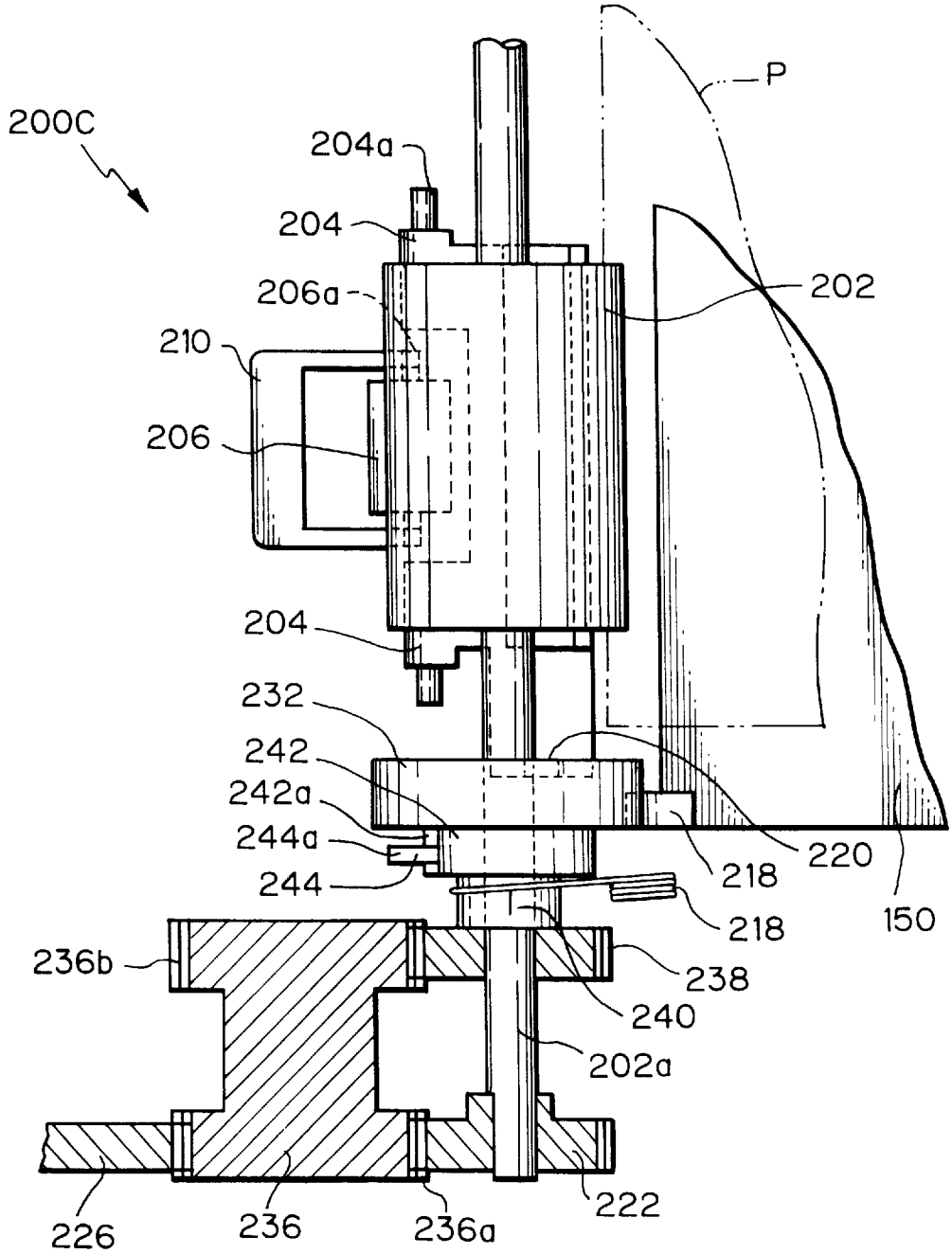
Figure 30:
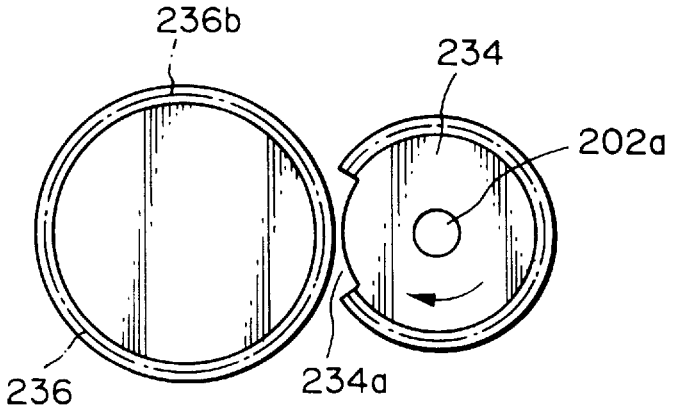
FIG. 30 shows a relation between a partial gear and an idle gear included in the eighth embodiment.

FIGS. 28–30 show a sheet feeding device 200C representative of an eighth embodiment of the present invention. As shown in FIGS. 28 and 29, the device 200C includes an eccentric cam 232 freely rotatable on the shaft 202*a* of the pick-up roller 202. The cam 232, like the cam 214, has a larger diameter portion 232*a* for pressing the lug 218 of the tray 150 and the lug 220 of the separator 204 downward, and smaller diameter portions 232*b* and 232*c* for releasing the lugs 218 and 220. In addition, the cam 232 has a partial gear 234 corresponding to the gear portion 216 of the cam 214.

An idle gear 236 transfers the rotation of the drive transmission mechanism 226 to the separator 202. The idle gear 236 has a first gear portion 236*a* held in mesh with the gear 222, and a second gear portion 236*b* capable of meshing with the partial gear 234. As shown in FIG. 30, the partial gear 234 has a toothless portion 234*a* facing the second gear portion 236*b* of the idle gear 236.

Further, the cam 232 includes a projection 240 constantly biased clockwise by a spring 238, and a portion 242 formed with a stepped portion or shoulder 242*a*. A lock lever or stop member 244 is rotatably mounted on a shaft 248. The lock lever 244 has a pawl 244*a* at one end and a drive end 244*b* at the other end. The pawl 244*a* is capable of abutting against the shoulder 242*a* of the above portion 242 while the drive end 244*b* is connected to a plunger 246*a* extending from a solenoid or actuator 246. The lock lever 244 is constantly biased by a spring 250 in a direction for causing the pawl 244*a* to abut against the shoulder 242*a*.

The idle gear 236 transmits the rotation of the drive transmission mechanism 226 to the pick-up roller 202. The partial gear 234 with the toothless portion 234*a* rotates together with the cam 232 when brought into mesh with the second gear 236*b* of the idle gear 236. The lock lever 244 stops the partial gear 234 at the position where the toothless portion 234*a* faces the second gear portion 236*b* of the gear 236. The spring 238 biases the partial gear 234 in a desired angular range. The solenoid 246 brings the stop lever 244 into engagement with the shoulder 242*a* of the partial gear 234 before the gear 234 completes one rotation. The idle gear 236, partial gear 234, stop lever 244, spring 238 and solenoid 246 constitute a one-rotation clutch 252.

FIG. 28 shows the device 200C in its home position, i.e., in the inoperative or the stand-by condition of the printer. In this condition, as shown in FIG. 30, the stop lever 244 stops the cam 232 with its pawl 244*a* abutting against the shoulder 242*a*, so that the toothless portion 234*a* of the partial gear 234 faces the second gear portion 236*b* of the idle gear 236. The lug 238 of the tray 150 and the lug 220 of the separator 204 remain in contact with the larger diameter portion 232*a* of the cam 232. Hence, the top sheet of the tray 150 and the pad 212 of the separator 204 are spaced from the pick-up roller 202.

When the controller included in the printer generates a sheet feed start command, the drive transmission mechanism 226 causes the pick-up roller 202 to rotate via the gear portion 236*a* of the idle gear 236 and the gear 222 of the shaft 202*a*. Substantially at the same time, the solenoid 246 is energized and pulls the plunger 246*a* thereinto. As a result, the stop lever 244 is rotated counterclockwise to release its pawl 244*a* from the shoulder 242*a*. Then, the projection 240 of the cam 232 is slightly rotated clockwise due to the action of the spring 238. This brings the partial gear 234 of the cam 232 into mesh with the gear portion 236*b* of the idle gear 236, thereby causing the cam 232 to start rotating clockwise. The larger diameter portion 232*a* of the cam 232 is moved upward and releases the lugs 218 and 220. Consequently, the tray 150 and separator 204 are raised due to the biasing forces, so that to sheet P of and pad 212 are pressed against the pick-up roller 202. In this condition, the pick-up roller 202 pays out the top sheet P in the previously stated manner.

Before the cam 232 completes one rotation, the solenoid 246 is deenergized and allows the stop lever 244 to return clockwise to its stand-by position due to the action of the spring 250. When the shoulder 242*a* arrives at the stand-by position of the stop lever 244, the pawl 244*a* abuts against the shoulder 242*a*. That is, the cam 232 completes one rotation and then stops at its home position. As a result, the top sheet P of the tray 150 and the pad 212 are released from the pick-up roller 202, so that the load on the sheet P is reduced.

When only one sheet P is fed, the pick-up roller 202 is rotated and then brought to a stop before the sheet P is handed over to the conveyance system of the image forming unit 160. During this period of time, the one-rotation clutch 252 controls one rotation of the cam 232. When two or more sheet P are continuously fed, the roller 202 is continuously rotated while the cam 232 is repeatedly rotated under the control of the one-rotation clutch 252. In this case, the cam 232 is brought to a stop at the previously stated home position without fail. The shoulder 242*a* and stop lever 244 engageable with each other allow the home position of the cam 232 to be accurately defined. This insures reliable operation for moving the tray 150 and separator 204 into and output of contact with the pick-up roller 202.

Figure 31:
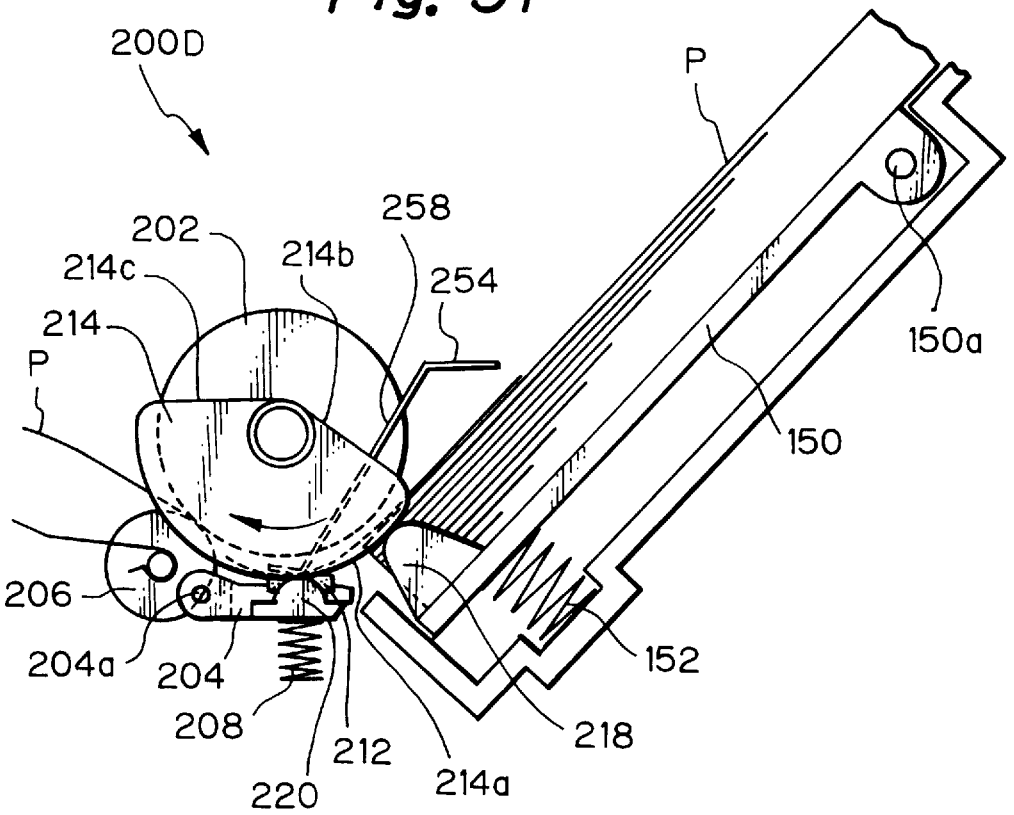
FIG. 31 shows a ninth embodiment of the present invention.
Figure 32:
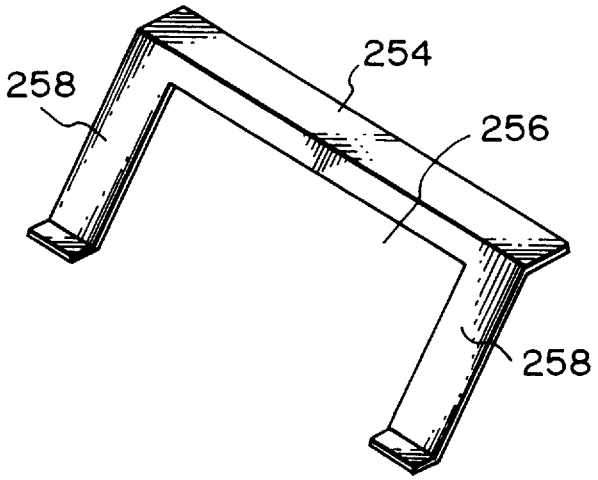
FIG. 32 is a perspective view showing a stop included in the ninth embodiment.

FIGS. 31, 32, 33A and 33B show a sheet feeding device 200D representative of a ninth embodiment of the present invention. As shown, the device 200D additionally includes an elastic stop 254 extending from above the leading end of the tray 150 to the separator 204. The stop 254 is pressed against the separator 204 due to its own elasticity. As shown in FIG. 32 in detail, the stop 254 has a pair of legs 258 for pressing the sheet P, and an open portion 256 defined between the legs 258 for receiving the pick-up roller 202. The stop 254 is supported by a member, not shown, and implemented as a film or a leaf spring of PET (Polyethylene Terephthalate) or similar elastic material.

Figure 33A:
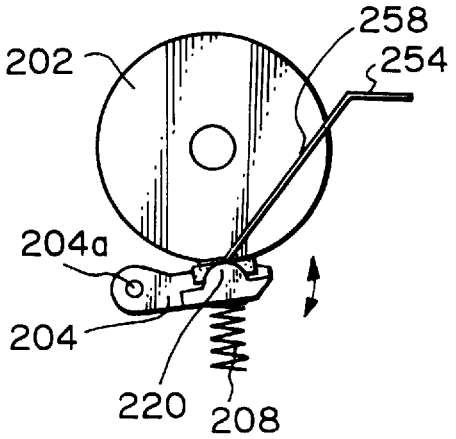
FIGS. 33A and 33B each shows the stop of FIG. 32 in a particular condition.
Figure 33B:
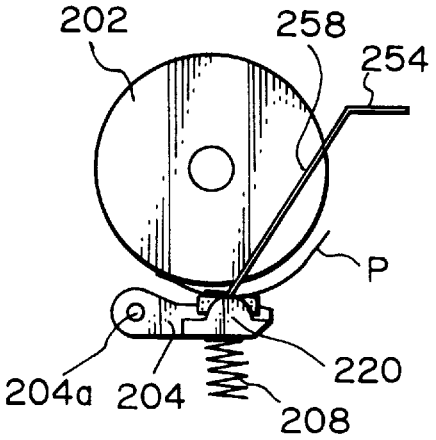

In the above configuration, the stop 254 remains in pressing contact with the separator 204 due to its own weight both when the separator 204 is pressed against the pick-up roller 202, as shown in FIG. 33A, and when the former is released from the latter, as shown in FIG. 33B.

In operation, when a plurality of sheets P are accidentally paid out together by the pick-up roller 202 to the surface of the separator 204, the separator 204 separates the top sheet P from the underlying sheets P and conveys it. As a result, the sheet P remains on the separator 204, as shown in FIG. 31. However, after the sheet P fed from the top of the stack has moved away from the nip between the pick-up roller 202 and the conveyor roller 206, the tray 150 and separator 204 are released from the pick-up roller 202. At this instant, the legs 258 of the stop 254 separate the sheet P remaining on the separator 204 from the pick-up roller 202 immediately. Therefore, the sheet P remaining on the separator 204 is prevented from being conveyed by the frictional force of the pick-up roller 202. Even if the sheets P on the tray 150 slip down toward the separator 204, their displacement in the sheet feed direction is restricted by the legs 258 of the stop 254. This obviates the simultaneous feed of two or more sheets.

Figure 34A:
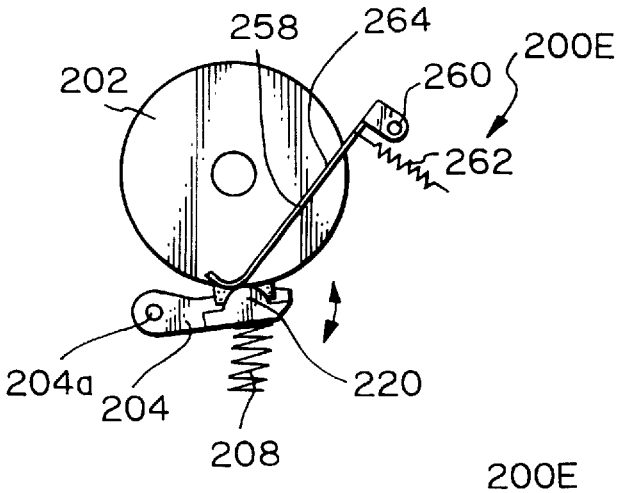
FIGS. 34A and 34B each shows a stop included in a tenth embodiment of the present invention in a particular condition.
Figure 34B:
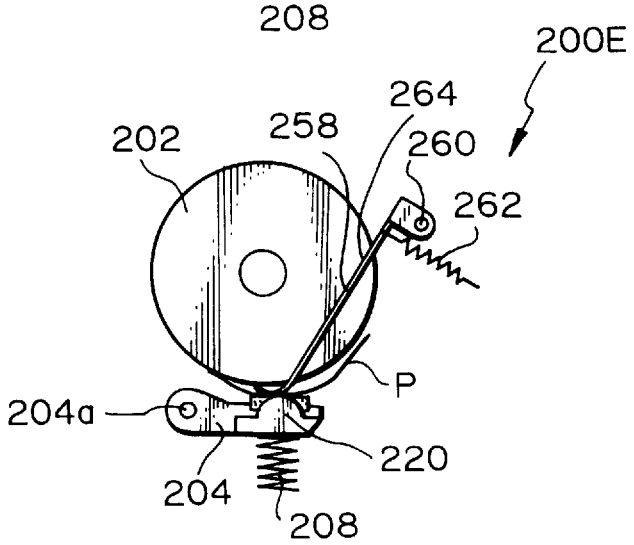
Figure 35:
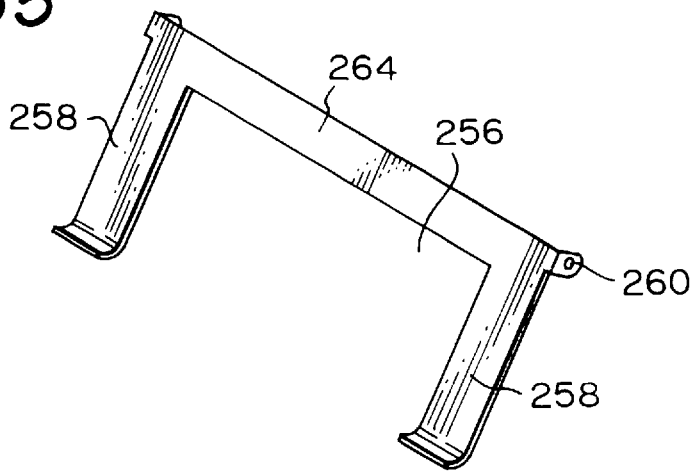
FIG. 35 is a perspective view of the stop of the tenth embodiment.
Figure 36A:
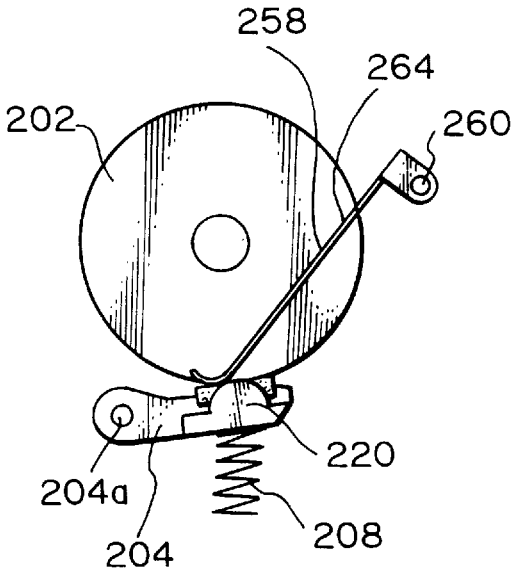
FIGS. 36A and 36B each shows a stop included in a modification of the tenth embodiment in a particular condition.
Figure 36B:
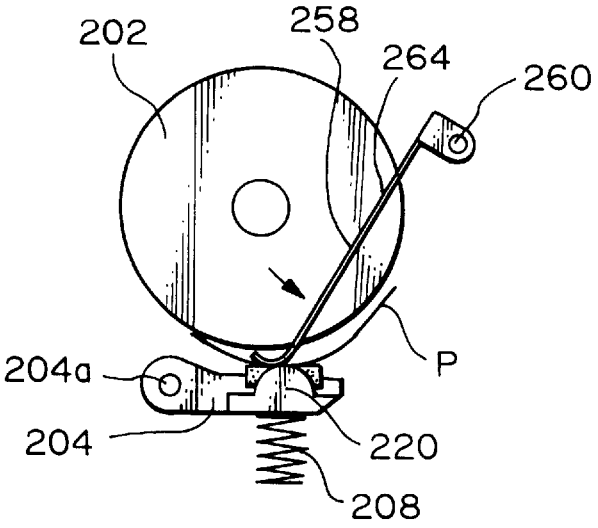

FIGS. 34A, 34B and 35 show a sheet feeding device 200E representative of a tenth embodiment of the present invention. As shown, the device 200E includes a stop 264 rotatable about a fulcrum 260 positioned above the front end of the tray 150, and extending toward the separator 204. The end of the stop 264 remote from the fulcrum 260 is held in contact with the separator 204 by a spring 262. The stop 264, like the stop 254, has the legs 258 and open portion 256. In this configuration, the stop 264 remains in pressing contact with the separator 204 due to the action of the spring 262 both when the separator 204 is pressed against the pick-up roller 202, as shown in FIG. 34A, and when the former is released from the latter, as shown in FIG. 34B. This embodiment therefore achieves the same advantage as the previous embodiment. Of course, the stop 264 may remain in contact with the separator 204 due to its own weight.

When the separator 204 is released from the pick-up roller 202, the stop 254 or 264 may not remain in contact the separator 204. The crux is that when the separator 204 is released from the pick-up roller 202, the sheet P remaining on the separator 204 is released from the pick-up roller 202.

The sixth to tenth embodiments shown and described have various advantages, as enumerated below.

(1) A sheet paid out by a pick-up roller can be conveyed to a desired position by the pick-up roller and a driven roller. Hence, the separation and conveyance of a sheet can be implemented by a single unit including a minimum number of parts. Because the driven roller cooperative with the pick-up roller is driven by the pick-up roller, a drive arrangement is simplified.

(2) Just after the start of sheet feed, a tray and a separator are released from a cam. Just after a sheet paid out from a tray has moved away from a nip between the pick-up roller and the driven roller, the tray and a separator are forced away from the pick-up roller by the larger diameter portion of the cam. Therefore, while the tray and separator are released from the cam, the top sheet is fed from the tray by being pressed against the pick-up roller, and the separator is pressed against the pick-up roller in order to avoid the simultaneous feed of two or more sheets. While the tray and separator are forced away from the pick-up roller by the cam, a load to act on the sheet being conveyed is reduced.

(3) The pick-up roller and cam can be driven by a drive section assigned to an image forming section. This simplifies the drive arrangement. In addition, because the movement of the pick-up roller is synchronous to the operation of the image forming section, an image can be formed in a preselected position on a sheet.

(4) The operator can load the tray with sheets without moving the tray away from the pick-up roller.

(5) Even when a sheet is left on the separator released from the pick-up roller, it is immediately released from the pick-up roller by a stop. Even if sheets on the tray slip down toward the separator, the stop restricts the displacement of the sheets in the sheet feed direction.

(6) While a torque is acting on the pick-up roller, the cam can complete one full rotation via a one-rotation clutch. Therefore, at the beginning of sheet feed, the tray and separator are released from the cam while the sheet and separator are pressed against the pick-up roller in order to separate and feed the sheet. During transport of the sheet, the tray and separator are released from the pick-up roller by the larger diameter portion of the cam so as to reduce the load acting on the sheet. In addition, the one-rotation clutch allows the cam to rotate at an accurate timing.

(7) The one-rotation clutch accurately determines the home position of the cam on the basis of a shoulder and a stop member capable of abutting against each other. This allows the tray and separator from moving into and out of contact with the pick-up roller with reliability.

Various modifications will become possible for those skilled in the art after receiving the teachings of the present disclosure without departing from the scope thereof.

What is claimed is:

1. A sheet feeding device for an image forming apparatus, comprising:

a pick-up roller operatively connected to and driven in synchronism with an image forming section included in said image forming apparatus;

a tray loaded with a stack of sheets;

first biasing means for constantly biasing said tray such that a top of the stack of sheets is pressed against a periphery of said pick-up roller;

a separating member located downstream of said tray in a conveyance path in an intended direction of sheet feed and movable into and out of contact with the periphery of said pick-up roller;

second biasing means for constantly biasing said separating member such that said separating member is pressed against the periphery of said pick-up roller;

a driven conveyor roller located downstream of said separating member in said conveyance path in the intended direction of sheet feed, and rotatably contacting the periphery of said pick-up roller;

third biasing means for constantly biasing said driven conveyor roller against the periphery of said pick-up roller;

drive means;

a cam controllably driven by said drive means so as to rotate in a same direction as said pick-up roller, and comprising a first cam portion for causing said tray to move toward said pick-up roller due to a force of said first biasing means, and a second cam portion for causing said separating member to move toward said pick-up roller due to a force of said second biasing means;

bias cancelling means for cancelling, after said cam has rotated a predetermined angle, pressing contact of said tray and said separating member with the periphery of said pick-up roller; and a regulating member not interfering with said conveyance path along which said sheet of the stack of sheets travels when said separating member is pressed against said pick-up roller, but existing in said conveyance path when said separating member is released from said pick-up roller, so as to interfere with said following sheet being fed along said conveyance path, said regulating member located downstream of said separating member and upstream of said driven conveyor roller.

2. A device as claimed in claim 1, wherein said regulating member comprises a pair of rollers mounted on a shaft of said pick-up roller at opposite ends of a range over which said separating member is capable of contacting said pick-up roller, wherein said pair of rollers are rotatable and movable up and down relative to said shaft and fall, when said separating member is released from said pick-up roller, due to weights thereof to partly exist in said transport path open.

3. A device as claimed in claim 2, wherein said pair of rollers are movable downward into contact with said separating member.

4. A device as claimed in claim 2, wherein said pair of rollers are each provided with an irregular circumferential surface.

5. A device as claimed in claim 2, wherein said separating member includes a pair of recesses for allowing said pair of rollers to fall while blocking said transport path.

6. A device as claimed in claim 1, wherein said regulating member comprises a stop wall protruding from a body of said image forming apparatus toward said conveyance path around said pick-up roller, and wherein said stop wall has a height selected such that said stop wall is hidden below a conveying surface of said separating member when said separating member is pressed against said pick-up roller, but protruded above said conveying surface when said separating member is released from said pick-up roller.

7. A device as claimed in claim 6, wherein said top wall is formed integrally with a guide member defining a sheet guide path between said separating member and said driven conveyor roller.

8. A sheet feeding device comprising:

a pick-up roller driven to rotate;

a tray loaded with a stack of sheets and constantly biased by first biasing means such that a top of the stack abuts against said pick-up roller;

a separating member located downstream of said tray in a conveyance path in an intended direction of sheet feed and contacting, under an action of second biasing means, said pick-up roller to thereby retain a sheet paid out together with a top sheet with a frictional force;

a driven conveyor roller located downstream of said separating member in said conveyance path in the intended direction of sheet feed and contacting, under an action of third biasing means, said pick-up roller and rotated by said pick-up roller to thereby convey the top sheet and a following sheet in cooperation with said pick-up roller;

a cam rotatable intermittently in synchronism with said pick-up roller, and including a larger diameter portion facing said tray and said separating member, and wherein said cam releases said tray and said separating member at the beginning of sheet feed or forces said tray and said separating member away from said pick-up roller with said larger diameter portion just after the top sheet has moved away from a nip between said pick-up roller and said driven conveyor roller; and a regulating member not interfering with said conveyance path along which said top sheet of the stack of sheets travels when said separating member is pressed against said pick-up roller, but existing in said conveyance path when said separating member is released from said pick-up roller, so as to interfere with said following sheet being fed along said conveyance path, said regulating member located downstream of said separating member and upstream of said driven conveyor roller.

9. A device as claimed in claim 8, wherein said cam forces said tray and said separating member away from said pick-up roller with said larger diameter portion against first and second biasing means when said device is out of operation or in a stand-by condition.

10. A device as claimed in claim 8, further comprising an elastic stop extending from above a front end of said tray in the intended direction of sheet feed toward a periphery of said separating member, and pressed against the periphery of said separating member due to elasticity of said stop.

11. A device as claimed in claim 8, further comprising a stop rotatable about a fulcrum positioned above a front end of said tray in the intended direction of sheet feed toward a periphery of said separating member, and having a front end pressed against the periphery of said separating member by fourth biasing means.

12. An image forming apparatus comprising:

an image forming section for forming an image on a sheet;

drive means;

a pick-up roller located upstream of said image forming section in a conveyance path in an intended direction of sheet feed, and rotated by and in synchronism with said drive means assigned to said image forming section;

a tray loaded with a stack of sheets and constantly biased by first biasing means such that a top of the stack abuts against said pick-up roller;

a separating member located downstream of said tray in said conveyance path in the intended direction of sheet feed and contacting, under an action of second biasing means, said pick-up roller to thereby retain a sheet paid out together with a top sheet with a frictional force;

a driven conveyor roller located downstream of said separating member in said conveyance path in the intended direction of sheet feed and contacting, under an action of third biasing means, said pick-up roller and rotated by said pick-up roller to thereby convey the top sheet and a following sheet in cooperation with said pick-up roller;

a cam including a larger diameter portion facing a part of said tray and said separating member;

cam drive control means for causing said cam to be rotated intermittently by and in synchronism with said drive means such that said cam releases said tray and said separating member at the beginning of sheet feed or forces said tray and said separating member away from said pick-up roller with said larger diameter portion just after the top sheet has moved away from a nip between said pick-up roller and said driven conveyor roller; and a regulating member not interfering with said conveyance path along which said top sheet of the stack of sheets travels when said separating member is pressed against said pick-up roller, but existing in said conveyance path when said separating member is released from said pick-up roller, so as to interfere with said following sheet being fed along said conveyance path, said regulating member located downstream of said separating member and upstream of said driven conveyor roller.

13. An apparatus as claimed in claim 12, wherein said cam drive control section comprises a one-rotation clutch for transmitting to said cam a driving force transferred from said drive section to said pick-up roller.

14. An apparatus as claimed in claim 13, wherein said one-rotation clutch comprises:

an idle gear for transmitting the driving force of said drive section to said pick-up roller;

a partial gear including a toothless portion and rotatable together with said cam when brought into mesh with said idle gear;

a movable stop member for stopping, when abutting against a shoulder included in said partial gear, said partial gear in a position where said toothless portion faces said idle gear;

a biasing member constantly biasing said partial gear in a direction of rotation within a preselected range; and an actuator for causing said stop member to retract from said partial gear and then to abut against said partial gear before said partial gear completes one full rotation.

15. An apparatus as claimed in claim 12, wherein said cam forces said tray and said separating member away from said pick-up roller against action of said first and second biasing means when said apparatus is out of operation or in a stand-by condition.

* * * * *